US010494579B2

(12) United States Patent
Wrigley et al.

(10) Patent No.: US 10,494,579 B2
(45) Date of Patent: Dec. 3, 2019

(54) NAPHTHENE-CONTAINING DISTILLATE STREAM COMPOSITIONS AND USES THEREOF

(71) Applicant: ExxonMobil Research and Engineering Company, Annandale, NJ (US)

(72) Inventors: Krystal B. Wrigley, Turnersville, NJ (US); Alexander S. Freer, Philadelphia, PA (US); Scott K. Berkhous, Mickleton, NJ (US); Sheryl B. Rubin-Pitel, Newtown, PA (US); Mike T. Noorman, Paulsboro, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 215 days.

(21) Appl. No.: 15/390,772

(22) Filed: Dec. 27, 2016

(65) Prior Publication Data

US 2017/0306253 A1 Oct. 26, 2017

Related U.S. Application Data

(60) Provisional application No. 62/327,624, filed on Apr. 26, 2016.

(51) Int. Cl.
*C10L 1/04* (2006.01)
*C10G 7/00* (2006.01)

(52) U.S. Cl.
CPC ..... *C10L 1/04* (2013.01); *C10G 7/00* (2013.01); *C10L 2200/0446* (2013.01)

(58) Field of Classification Search
CPC ..... C10L 1/04; C10L 2200/0446
USPC ..... 208/14
See application file for complete search history.

(56) References Cited

U.S. PATENT DOCUMENTS

| | | | |
|---|---|---|---|
| 1,815,022 | A | 7/1931 | Davis |
| 1,948,296 | A | 2/1934 | Haylett |
| 2,015,748 | A | 10/1935 | Frolich |
| 2,081,473 | A | 5/1937 | Bray et al. |
| 2,100,993 | A | 11/1937 | Bruson |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |

(Continued)

FOREIGN PATENT DOCUMENTS

| | | | |
|---|---|---|---|
| CA | 1094044 | A | 1/1981 |
| EP | 0099141 | A | 1/1984 |

(Continued)

OTHER PUBLICATIONS

The Partial International Search Report of PCT/US2016/068784 dated Mar. 17, 2017.

(Continued)

*Primary Examiner* — Ellen M McAvoy
(74) *Attorney, Agent, or Firm* — Robert A. Migliorini; Kristina Okafor; Anthony G. Boone

(57) ABSTRACT

Naphthene-containing distillate compositions are provided herein. Methods of improving fuel compositions and blends using the naphthene-containing distillate compositions are also provided herein.

21 Claims, 2 Drawing Sheets

(56) References Cited

U.S. PATENT DOCUMENTS 2,721,878 A 10/1955 Popkin
3,036,003 A 5/1962 Verdol
3,087,936 A 4/1963 LeSuer
3,172,892 A 3/1965 LeSuer et al.
3,200,107 A 8/1965 LeSuer
3,215,707 A 11/1965 Rense
3,219,666 A 11/1965 Norman et al.
3,250,715 A 5/1966 Wyman
3,254,025 A 5/1966 LeSuer
3,272,746 A 9/1966 LeSuer et al.
3,275,554 A 9/1966 Wagenaar
3,287,254 A 11/1966 Paterson
3,316,177 A 4/1967 Dorer, Jr.
3,322,670 A 5/1967 Burt et al.
3,329,658 A 7/1967 Fields
3,341,542 A 9/1967 LeSuer et al.
3,413,347 A 11/1968 Worrel
3,414,506 A 12/1968 Van Lookeren Campagne
3,438,757 A 4/1969 Honnen et al.
3,444,170 A 5/1969 Norman et al.
3,449,250 A 6/1969 Fields
3,454,555 A 7/1969 van der Voort et al.
3,454,607 A 7/1969 LeSuer et al.
3,519,565 A 7/1970 Coleman
3,541,012 A 11/1970 Stuebe
3,565,804 A 2/1971 Honnen et al.
3,595,791 A 7/1971 Cohen
3,627,675 A 12/1971 Ditman et al.
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,751,365 A 8/1973 Piasek et al.
3,755,433 A 8/1973 Miller et al.
3,756,953 A 9/1973 Piasek et al.
3,787,374 A 1/1974 Adams
3,798,165 A 3/1974 Piasek et al.
3,803,039 A 4/1974 Piasek et al.
3,822,209 A 7/1974 Knapp et al.
3,948,800 A 4/1976 Meinhardt
4,100,082 A 7/1978 Clason et al.
4,234,435 A 11/1980 Meinhardt et al.
4,426,305 A 1/1984 Malec
4,454,059 A 6/1984 Pindar et al.
4,715,946 A 12/1987 Le Page et al.
4,767,551 A 8/1988 Hunt et al.
4,798,684 A 1/1989 Salomon
4,982,051 A 1/1991 Pasternak et al.
5,084,197 A 1/1992 Galic et al.
5,124,025 A 6/1992 Kolstad et al.
5,358,627 A 10/1994 Mears et al.
5,705,458 A 1/1998 Roby et al.
5,871,634 A 2/1999 Wiehe et al.
5,976,353 A 11/1999 Cody et al.
6,034,039 A 3/2000 Gomes et al.
6,241,874 B1 6/2001 Wallace et al.
6,323,164 B1 11/2001 Liesen et al.
6,461,497 B1 10/2002 Pedersen
6,814,856 B1 11/2004 Aussillous et al.
7,029,571 B1 4/2006 Bharracharyya et al.
7,261,805 B2 8/2007 Grove et al.
7,381,321 B2 6/2008 Benazzi et al.
7,598,426 B2 10/2009 Fang et al.
7,704,930 B2 4/2010 Deckman et al.
7,776,206 B2 8/2010 Miller et al.
8,048,833 B2 11/2011 Habeeb et al.
8,361,309 B2 1/2013 Lopez et al.
8,366,908 B2 2/2013 Prentice et al.
8,394,255 B2 3/2013 McCarthy et al.
8,492,321 B2 7/2013 Goujon et al.
8,513,150 B2 8/2013 Wu
8,541,635 B2 9/2013 Landschof
8,557,106 B2 10/2013 Novak et al.
8,617,383 B2 12/2013 Prentice et al.
8,658,030 B2 2/2014 Osaheni et al.
8,778,171 B2 7/2014 Oliveri et al.
8,785,354 B2 7/2014 Westelynck et al.
8,932,454 B2 1/2015 Wu et al.
8,992,764 B2 3/2015 Prentice et al.
8,992,770 B2 * 3/2015 Gong ..... G01N 33/2823 208/291
9,005,380 B2 4/2015 Mathur
9,035,113 B2 5/2015 Lopez et al.
9,200,218 B2 12/2015 Dougherty et al.
9,315,742 B2 * 4/2016 Aubry ..... C10G 45/44
9,418,828 B2 8/2016 Mennito et al.
2004/0020826 A1 * 2/2004 Guyomar ..... C10G 47/00 208/108
2004/0094453 A1 5/2004 Lok et al.
2004/0178118 A1 9/2004 Rosenbaum et al.
2004/0250466 A1 12/2004 Fang et al.
2005/0098476 A1 5/2005 Miller
2006/0101712 A1 5/2006 Burnett et al.
2006/0111599 A1 5/2006 Lamprecht et al.
2006/0118463 A1 6/2006 Colyar et al.
2006/0163115 A1 7/2006 Montanari et al.
2007/0181461 A1 8/2007 Adams et al.
2008/0149534 A1 6/2008 Gauthier et al.
2008/0308459 A1 12/2008 Iki et al.
2009/0294328 A1 12/2009 Iqbal
2009/0313890 A1 12/2009 Lopez et al.
2010/0077842 A1 4/2010 Rosenbaum et al.
2010/0270205 A1 * 10/2010 Lopez ..... C10G 45/44 208/17
2011/0005190 A1 * 1/2011 Bauldreay ..... C10L 1/04 60/39.461
2011/0303585 A1 12/2011 Dath et al.
2011/0315596 A1 12/2011 Prentice et al.
2012/0000829 A1 1/2012 Dougherty et al.
2012/0012087 A1 * 1/2012 Cannella ..... C10L 1/04 123/568.11
2012/0132182 A1 * 5/2012 Gunter ..... C10L 1/08 123/568.11
2013/0048537 A1 2/2013 Noh et al.
2013/0092598 A1 4/2013 Joseck et al.
2013/0146508 A1 6/2013 Quignard et al.
2013/0264246 A1 10/2013 Holtzer et al.
2013/0341243 A1 12/2013 Novak et al.
2014/0197071 A1 7/2014 Prentice et al.
2014/0274827 A1 9/2014 Lyon et al.
2015/0014217 A1 1/2015 Smiley et al.
2015/0152343 A1 6/2015 Vijay et al.
2015/0175911 A1 6/2015 Shih et al.
2015/0218466 A1 8/2015 Prentice et al.
2015/0344807 A1 12/2015 Takeshima
2016/0281009 A1 9/2016 Aubry et al.
2018/0327680 A1 * 11/2018 Price ..... C10L 1/08

FOREIGN PATENT DOCUMENTS

EP 0471071 B1 8/1995
EP 1452579 A1 9/2004
GB 1174593 A 12/1969
GB 1216198 A 12/1970
GB 1270438 A 4/1972
GB 1440230 A 6/1976
JP 2004002551 A 1/2004
JP 2004067906 A 3/2004
JP 3866380 B2 1/2007
JP 2007009159 A 1/2007
JP 3999911 B2 10/2007
JP 3999912 B2 10/2007
JP 4072396 B2 4/2008
JP 4152127 B2 9/2008
JP 4268373 B2 5/2009

(56) References Cited

FOREIGN PATENT DOCUMENTS

| | | | |
|---|---|---|---|
| JP | 2009292934 | A | 12/2009 |
| JP | 4482469 | B2 | 6/2010 |
| JP | 4482470 | B2 | 6/2010 |
| JP | 2010215723 | A | 9/2010 |
| JP | 4563216 | B2 | 10/2010 |
| JP | 4567947 | B2 | 10/2010 |
| JP | 4567948 | B2 | 10/2010 |
| JP | 2010241869 | A | 10/2010 |
| JP | 2010241875 | A | 10/2010 |
| JP | 4575646 | B2 | 11/2010 |
| JP | 4593376 | B2 | 12/2010 |
| JP | 4620381 | B2 | 1/2011 |
| JP | 2012021085 | A | 2/2012 |
| JP | 4994327 | B2 | 8/2012 |
| JP | 5043754 | B2 | 10/2012 |
| JP | 5052874 | B2 | 10/2012 |
| JP | 5052875 | B2 | 10/2012 |
| JP | 5052876 | B2 | 10/2012 |
| JP | 5128631 | B2 | 1/2013 |
| JP | 5128632 | B2 | 1/2013 |
| JP | 5128633 | B2 | 1/2013 |
| JP | 2013040352 | A | 2/2013 |
| JP | 5166686 | B2 | 3/2013 |
| JP | 5205639 | B2 | 6/2013 |
| JP | 5205640 | B2 | 6/2013 |
| JP | 5205641 | B2 | 6/2013 |
| JP | 5312646 | B2 | 10/2013 |
| JP | 5328973 | B2 | 10/2013 |
| JP | 5361499 | B2 | 12/2013 |
| JP | 5467890 | B2 | 4/2014 |
| JP | 5518454 | B2 | 6/2014 |
| JP | 5520101 | B2 | 6/2014 |
| JP | 5520114 | B2 | 6/2014 |
| JP | 5520115 | B2 | 6/2014 |
| JP | 5615215 | B2 | 10/2014 |
| JP | 5632522 | B2 | 11/2014 |
| JP | 2015113405 | A | 6/2015 |
| JP | 2016008263 | A | 1/2016 |
| KR | 1566581 | B1 | 11/2015 |
| WO | 2004078885 | A1 | 9/2004 |
| WO | 2004093559 | A2 | 11/2004 |
| WO | 2014175952 | A1 | 10/2014 |

OTHER PUBLICATIONS

The International Search Report and Written Opinion of PCT/US2016/068779 dated Mar. 29, 2017.
The International Search Report and Written Opinion of PCT/US2016/068786 dated Mar. 24, 2017.
The Partial International Search Report of PCT/US2016/068796 dated Mar. 21, 2017.
The Partial International Search Report of PCT/US2016/068803 dated Mar. 15, 2017.
The International Search Report and Written Opinion of PCT/US2016/068806 dated Mar. 21, 2017.
U.S. Appl. No. 15/390,794.
U.S. Appl. No. 15/390,832.
U.S. Appl. No. 15/390,896.
U.S. Appl. No. 15/390,780.
U.S. Appl. No. 15/390,784.
The International Search Report and Written Opinion of PCT/US2016/068784 dated Jun. 6, 2017.
The International Search Report and Written Opinion of PCT/US2016/068778 dated Jun. 12, 2017.
The International Search Report and Written Opinion of PCT/US2016/068781 dated Jun. 14, 2017.
The International Search Report and Written Opinion of PCT/US2016/068796 dated May 29, 2017.
The International Search Report and Written Opinion of PCT/US2016/068801 dated Apr. 21, 2017.
The International Search Report and Written Opinion of PCT/US2016/068803 dated Jun. 9, 2017.
Laredo, Georgina C. et al., "High quality diesel by hydrotreating of atmospheric gas oil/light cycle oil blends", Fuel, 2004, vol. 83, pp. 1381-1389.
U.S. Appl. No. 15/390,790.
U.S. Appl. No. 15/390,943.
U.S. Appl. No. 15/390,775.

* cited by examiner

NAPHTHENE-CONTAINING DISTILLATE STREAM COMPOSITIONS AND USES THEREOF

CROSS-REFERENCE TO RELATED APPLICATIONS

This application claims priority to U.S. Provisional Application Ser. No. 62/327,624 filed on Apr. 26, 2016, which is herein incorporated by reference in its entirety.

FIELD

This invention relates to naphthene-containing distillate stream compositions and use of the distillate stream compositions as a fuel, blendstocks and in methods of improving fuel compositions.

BACKGROUND

Refinery streams typically require blending with one or more other streams and/or additives in various proportions to produce a finished product (e.g., diesel fuel, jet fuel, gasoline) with properties that meets all the industry and government standards. Such standards relate to chemical properties (e.g., aromatic content, sulfur content, etc.), physical properties (e.g., viscosity, boiling-range, etc.) and performance properties (e.g., cetane number, smoke point, etc.) of the finished product. Additionally, lower quality blendstocks (e.g., light cycle oil) may be upgraded to, e.g., diesel fuel, by blending with one or more other streams and/or additives as well.

Blending generally requires various streams and/or additives because many blend components have properties that achieve some but not all of the required standards for the finished product. For example, additives for improving properties such as cetane number or lubricity typically only improve one property at a time. Thus, it is typically not simple to simultaneously improve multiple properties. More problematic is that sometimes in improving one property degradation of other properties may occur. For instance, a lighter kerosene type material has traditionally been used to improve cloud point of a base diesel stream. However, the lighter kerosene type material can also decrease density and potentially lower cetane number depending on the starting cetane value. Furthermore, refiners are obligated to blend ever increasing amounts of renewable blend components, such as fatty acid methyl ester (FAME) or renewable diesel. However, those renewable blend components, while able to increase cetane number, may undesirably lower energy density and cloud point of the finished product.

Therefore, there is a need for distillate compositions with combinations of improved chemical, physical and performance properties that can be blended with various refinery streams to produce finished products with improved properties that meet appropriate standards. There is also a need for distillate compositions with combinations of improved chemical, physical and performance properties that can be used as a finished fuel product in neat form as well.

SUMMARY

It has been found that naphthene-containing distillate compositions produced during hydroprocessing (hydrocracking) of petroleum feeds can have desirable combinations of physical, chemical and performance properties and such naphthene-containing distillate compositions can be blended with various refinery streams to produce finished products (e.g., diesel fuel) that meet appropriate standards. Further, such naphthene-containing distillate compositions may be used as a finished fuel product (e.g., diesel fuel) in neat form as well.

Thus, in some aspects, embodiments of the invention can provide a distillate composition comprising: naphthenes in an amount of at least about 50 wt %; aromatics in an amount less than about 1.5 wt %; and isoparaffins in an amount of about 5.0 wt % to about 50 wt %.

Additionally or alternatively, embodiments of the invention can provide a distillate composition comprising naphthenes in an amount of at least about 50 wt %; aromatics in an amount less than about 1.5 wt %; and sulfur in an amount less than about 0.00050%, wherein the distillate composition has a volumetric energy content of at least about 131,000 BTU/gallon.

Further additionally or alternatively, embodiments of the invention can provide a distillate composition comprising naphthenes in an amount of at least about 50 wt % and isoparaffins in an amount of about 5.0 wt % to about 50 wt %, wherein the distillate composition exhibits a cloud point less than about −40° C. and a cold filter plugging point less than about −22° C.

Still further additionally or alternatively, embodiments of the invention can provide a diesel boiling-range fuel blend comprising the distillate composition described herein and a second distillate composition.

Yet further additionally or alternatively, embodiments of the invention can provide a method of producing diesel boiling-range fuel with improved cold flow properties, the method comprising blending the distillate composition as described herein with at least a second distillate composition to form the diesel boiling-range fuel.

Yet still further additionally or alternatively, embodiments of the invention can provide a method of increasing fuel economy of a diesel boiling-range fuel, the method comprising blending the distillate composition described herein with a second distillate composition to form the diesel boiling-range fuel.

Other embodiments, including particular aspects of the embodiments summarized above, should be evident from the detailed description that follows.

DETAILED DESCRIPTION

Figure 1:
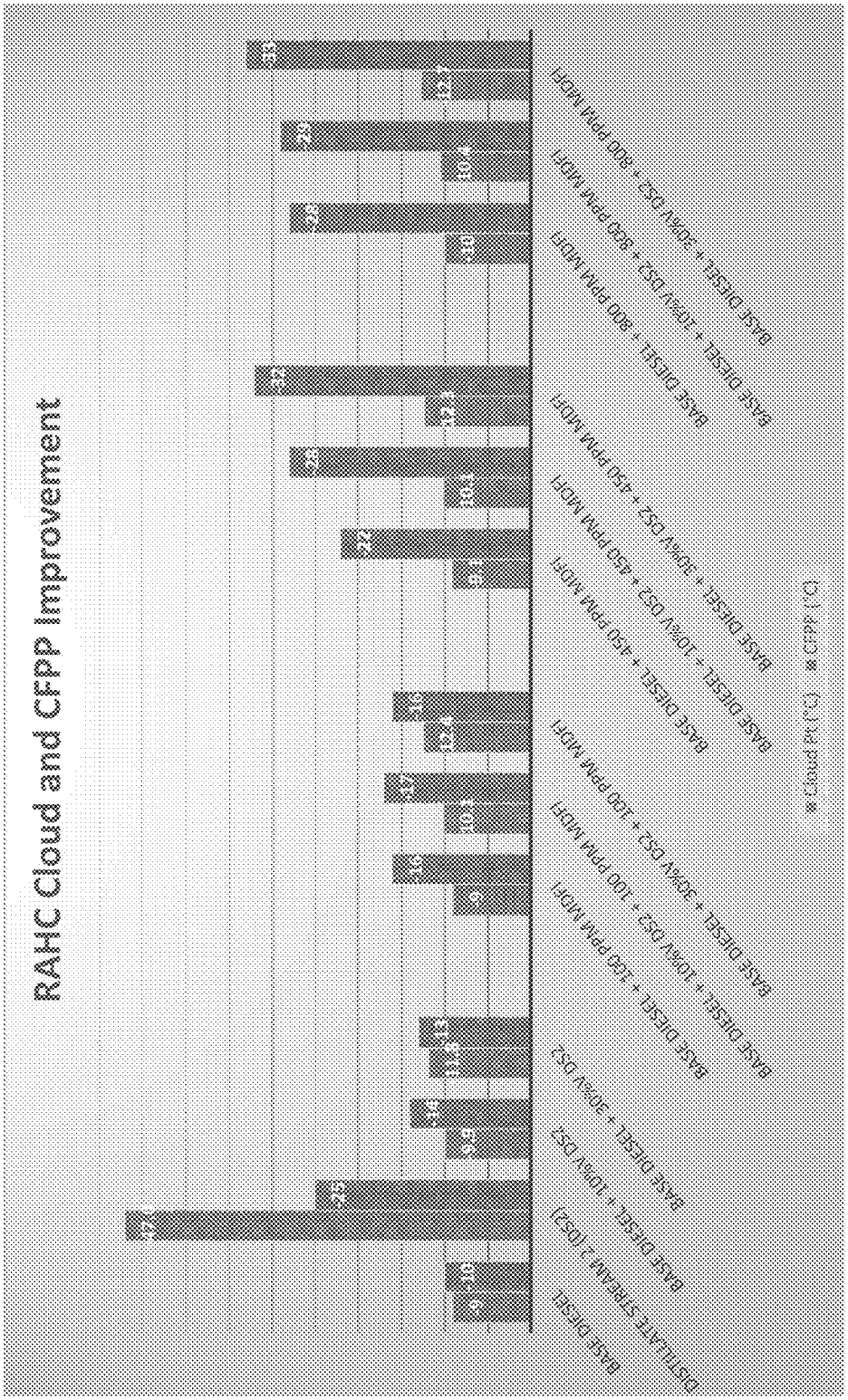
FIG. 1 illustrates cloud point and cold filter plugging point improvement with various blends of base diesel, distillate stream 2 and distillate flow improver (MDFI) additive.

In various aspects of the invention, distillate compositions, diesel boiling-range fuel blends, methods for preparing distillate boiling-range fuel blends and methods for improving diesel boiling-range fuel blends are provided.

I. Definitions

For purposes of this invention and the claims hereto, the numbering scheme for the Periodic Table Groups is according to the IUPAC Periodic Table of Elements.

The term "and/or" as used in a phrase such as "A and/or B" herein is intended to include "A and B", "A or B", "A", and "B".

As used herein, and unless otherwise specified, the term "$C_n$" means hydrocarbon(s) having n carbon atom(s) per molecule, wherein n is a positive integer.

As used herein, and unless otherwise specified, the term "hydrocarbon" means a class of compounds containing hydrogen bound to carbon, and encompasses (i) saturated hydrocarbon compounds, (ii) unsaturated hydrocarbon compounds, and (iii) mixtures of hydrocarbon compounds (saturated and/or unsaturated), including mixtures of $C_n$ hydrocarbon compounds having different values of n. As those of ordinary skill in the art know well, hydrocarbons as a generic classification can optionally (but typically) include relatively small amounts of individual components that have covalent bonds between atoms other than carbon or hydrogen (e.g., including heteroatoms such as O, N, S, and/or P, inter alia). Nevertheless, as used herein, individually-enumerated species of hydrocarbons, unless specifically known to be part of the stated chemical structure/nature, are not meant to include species having covalent bonds between atoms other than carbon or hydrogen.

As used herein, the term "alkane" refers to non-aromatic saturated hydrocarbons with the general formula $C_nH_{(2n+2)}$, where n is 1 or greater. An alkane may be straight chained or branched. Examples of alkanes include, but are not limited to methane, ethane, propane, butane, pentane, hexane, heptane and octane. "Alkane" is intended to embrace all structural isomeric forms of an alkane. For example, butane encompasses n-butane and isobutane; pentane encompasses n-pentane, isopentane and neopentane.

As used herein, and unless otherwise specified, the term "aromatic" refers to unsaturated cyclic hydrocarbons having a delocalized conjugated π system and having from 5 to 30 carbon atoms (aromatic $C_5$-$C_{30}$ hydrocarbon). Exemplary aromatics include, but are not limited to benzene, toluene, xylenes, mesitylene, ethylbenzenes, cumene, naphthalene, methylnaphthalene, dimethylnaphthalenes, ethylnaphthalenes, acenaphthalene, anthracene, phenanthrene, tetraphene, naphthacene, benzanthracenes, fluoranthrene, pyrene, chrysene, biphenylene, and the like, and combinations thereof. Additionally, the aromatic may comprise one or more heteroatoms. Examples of heteroatoms include, but are not limited to, nitrogen, oxygen, and/or sulfur. Aromatics with one or more heteroatom include, but are not limited to furan, benzofuran, thiophene, benzothiophene, oxazole, thiazole and the like, and combinations thereof. The aromatic may comprise monocyclic, bicyclic, bicyclic, and/or polycyclic rings (in some embodiments, at least monocyclic rings, only monocyclic and bicyclic rings, or only monocyclic rings) and may be fused rings.

As used herein, and unless otherwise specified, the term "paraffin," alternatively referred to as "alkane," refers to a saturated hydrocarbon chain of 1 to about 30 carbon atoms in length, such as, but not limited to methane, ethane, propane and butane. The paraffin may be straight-chain, cyclic or branched-chain. "Paraffin" is intended to embrace all structural isomeric forms of paraffins. The term "acyclic paraffin" refers to straight-chain or branched-chain paraffins. The term "isoparaffin" refer to branched-chain paraffin, and the term "n-paraffin" or "normal paraffin" refers to straight-chain paraffins.

As used herein, and unless otherwise specified, the term "naphthene" refers to a cycloalkane (also known as a cycloparaffin) having from 3-30 carbon atoms. Examples of naphthenes include, but are not limited to cyclopropane, cyclobutane, cyclopentane, cyclohexane, cycloheptane, cyclooctane and the like. The term naphthene encompasses single-ring naphthenes and multi-ring naphthenes. The multi-ring naphthenes may have two or more rings, e.g., two-rings, three-rings, a four-rings, five-rings, six-rings, seven-rings, eight-rings, a nine-rings, and ten-rings. The rings may be fused and/or bridged. The naphthene can also include various side chains, particularly one or more alkyl side chains of 1-10 carbons.

As used herein, and unless otherwise specified, the term "diesel boiling-range fuel" refers to a hydrocarbon product having a boiling point range from about 110° C. (initial number represents IBP, or alternatively T1 or T2) to about 425° C. (final number represents FBP, or alternatively T99 or T98), e.g., from about 110° C. to about 400° C., from about 110° C. to about 385° C., from about 110° C. to about 360° C., from about 120° C. to about 425° C., from about 120° C. to about 400° C., from about 120° C. to about 385° C., from about 120° C. to about 360° C., from about 140° C. to about 425° C., from about 140° C. to about 400° C., from about 140° C. to about 385° C., or from about 140° C. to about 360° C., as measured by ASTM D2887 (Simulated Distillation, or SIMDIS). IBP and FBP represent initial boiling point and final boiling point, respectively. Txx represents the temperature at which about xx % of the hydrocarbon product boils—for instance, T2 is the point at which about 2% of the hydrocarbon product boils. Diesel boiling-range fuel may be used in any suitable engine or process which requires or can utilize the above-mentioned boiling point range, e.g., as transportation fuel, turbine fuel, bunker fuel, and/or heating fuel.

Diesel feedstreams suitable for use in the invention can have a boiling range from about 215° F. (about 102° C.) to about 800° F. (about 427° C.). In such embodiments, the diesel boiling range feedstream can have an initial boiling point of at least about 250° F. (about 121° C.), for example at least about 300° F. (about 149° C.), at least about 350° F. (about 177° C.), at least about 400° F. (about 204° C.), or at least about 451° F. (about 233° C.). Additionally or alternately in such embodiments, the diesel boiling range feedstream can have a final boiling point of about 800° F. (about 427° C.) or less, for example about 775° F. (about 413° C.) or less, about 750° F. (about 399° C.) or less. Further additionally or alternately, the diesel boiling range feedstream can have a boiling range from about 451° F. (about 233° C.) to about 800° F. (about 427° C.).

As used therein, and unless otherwise specified, the terms "renewable distillate" and "renewable diesel" refer to any distillate/diesel composition derived from a biological source or biomass obtained through processes such as, but not limited to, hydrotreating, thermal conversion, and/or biomass-to-liquid. An example of renewable distillate/diesel is hydrotreated vegetable oil (HVO).

As used herein, the term "biomass" refers to animal fats, vegetable oils, waste materials, and/or even cellulosic materials (e.g., grasses). Exemplary animal fats include, but are not limited to, tallow, lard, yellow grease, chicken fat, fish oils, fish fats, by-products from the production of Omega-3 fatty acids from fish oil, and combinations thereof. Exemplary vegetable oils include, but are not limited to, rapeseed oil, soybean oil, palm oil, corn oil, canola oil, and combinations thereof. Exemplary waste materials include, but are not limited to, used cooking oils, waste fish fat/oil, palm/vegetable oil fatty acid distillate materials, tall oil, tall oil pitch, and combinations thereof.

As used herein, the term "biological source" refers to animal fats/oils (including fish fats/oils), vegetable fats/oils, microbial oils, algae-derived oils, lipids, oils derived from seeds (e.g., rapeseed, grapeseed, mustard, pennycress, Jatropha, and combinations thereof), and combinations thereof.

As used herein, the terms "FAME" and "biodiesel" are used interchangeable to mean fatty acid methyl esters, which refer to methylated esters of biological source materials (typically of vegetable/seed, and/or animal origin), e.g., derived through processes such as, but not limited to, esterification, transesterification, and/or solid acid catalytic esterification. Occasionally, these terms are used to genetically refer to fatty acid alkyl esters (or "FAAE" materials), which refer to alkylated esters of biological source materials. Exemplary FAMEs/biodiesels include, but are not limited to, soybean oil alkyl (methyl) esters, canola oil alkyl (methyl) esters, rapeseed oil alkyl (methyl) esters, grapeseed oil alkyl (methyl) esters, corn oil alkyl (methyl) esters, alkyl (methyl) esters of waste oils (e.g., used cooking oils, brown greases, and/or yellow greases), alkyl (methyl) esters of animal fats/oils (e.g., tallow oil, lard, poultry fats, and/or fish fats/oils), and combinations thereof.

II. Distillate Compositions

II.A. Naphthenes

The invention relates to distillate streams (compositions), particularly naphthene-containing distillate streams (compositions). The distillate compositions may be produced from various refinery feedstocks. In particular, the distillate compositions may be produced during hydroprocessing (e.g., hydroconversion, hydrotreatment, hydrocracking) of the refinery feedstocks. Examples of suitable refinery feedstocks include, but are not limited to whole crude petroleum, cycle oil, gas oils, vacuum gas oil, FCC tower bottoms, deasphalted residua, atmospheric and vacuum residua, bright stock, coker gas oils, other heavy oils, light to heavy distillates including raw virgin distillates, hydrocrackates, hydrotreated oils, dewaxed oils, slack waxes, Fischer-Tropsch waxes, and mixtures thereof.

In many embodiments, a distillate composition can advantageously comprise naphthenes. The naphthenes may be present in the distillate composition in an amount of at least about 35 wt %, for example, at least about 40 wt %, at least about 45 wt %, at least about 50 wt %, at least about 55 wt %, at least about 60 wt %, at least about 65 wt %, at least about 70 wt %, at least about 75 wt %, at least about 80 wt %, at least about 85 wt % or at least about 90 wt %. In particular, naphthenes may be present in an amount of at least about 50 wt %, at least about 60 wt %, or at least about 70 wt %. Additionally or alternatively, the naphthenes may be present in the distillate composition in an amount of about 35 wt % or less, for example about 40 wt % or less, about 45 wt % or less, about 50 wt % or less, about 55 wt % or less, about 60 wt % or less, about 65 wt % or less, about 70 wt % or less, about 75 wt % or less, about 80 wt % or less, about 85 wt % or less, or about 90 wt % or less. Further additionally or alternatively, the naphthenes may be present in the distillate composition in an amount of about 35 wt % to about 90 wt %, for example about 35 wt % to about 85 wt %, about 35 wt % to about 80 wt %, about 35 wt % to about 75 wt %, about 35 wt % to about 70 wt %, about 35 wt % to about 65 wt %, about 35 wt % to about 60 wt %, about 35 wt % to about 55 wt %, about 35 wt % to about 50 wt %, about 40 wt % to about 90 wt %, about 40 wt % to about 85 wt %, about 40 wt % to about 80 wt %, about 40 wt % to about 75 wt %, about 40 wt % to about 70 wt %, about 40 wt % to about 65 wt %, about 40 wt % to about 60 wt %, about 40 wt % to about 55 wt %, about 40 wt % to about 50 wt %, about 45 wt % to about 90 wt %, about 45 wt % to about 85 wt %, about 45 wt % to about 80 wt %, about 45 wt % to about 75 wt %, about 45 wt % to about 70 wt %, about 45 wt % to about 65 wt %, about 45 wt % to about 60 wt %, about 45 wt % to about 55 wt %, about 45 wt % to about 50 wt %, about 50 wt % to about 90 wt %, about 50 wt % to about 85 wt %, about 50 wt % to about 80 wt %, about 50 wt % to about 75 wt %, about 50 wt % to about 70 wt %, about 50 wt % to about 65 wt %, about 50 wt % to about 60 wt %, about 50 wt % to about 55 wt %, about 55 wt % to about 90 wt %, about 55 wt % to about 85 wt %, about 55 wt % to about 80 wt %, about 55 wt % to about 75 wt %, about 55 wt % to about 70 wt %, about 55 wt % to about 65 wt %, about 55 wt % to about 60 wt %, about 60 wt % to about 90 wt %, about 60 wt % to about 85 wt %, about 60 wt % to about 80 wt %, about 60 wt % to about 75 wt %, about 60 wt % to about 70 wt %, about 60 wt % to about 65 wt %, about 65 wt % to about 90 wt %, about 65 wt % to about 85 wt %, about 65 wt % to about 80 wt %, about 65 wt % to about 75 wt %, about 65 wt % to about 70 wt %, about 70 wt % to about 90 wt %, about 70 wt % to about 85 wt %, about 70 wt % to about 80 wt %, about 70 wt % to about 75 wt %, about 75 wt % to about 90 wt %, about 75 wt % to about 85 wt %, about 75 wt % to about 80 wt %, about 80 wt % to about 90 wt %, or about 80 wt % to about 85 wt %. In particular, naphthenes can be present in the distillate composition in an amount of about 40 wt % to about 90 wt %, about 50 wt % to about 85 wt %, or about 60 wt % to about 85 wt % or about 60 wt % to about 80 wt %.

The naphthenes present in the distillate composition may be single ring naphthenes and/or multi-ring naphthenes. The multi-ring naphthenes may be from two-ring to ten-ring naphthenes. In particular, the multi-ring naphthenes may be selected from the group consisting of two-ring naphthenes, three-ring naphthenes, four-ring naphthenes, five-ring naphthenes, six-ring naphthenes, and combinations thereof.

In various aspects, single ring naphthenes may represent at least about 30% w/w of the total amount of naphthenes, for example at least about 35% w/w, at least about 40% w/w, at least about 45% w/w, at least about 50% w/w, at least about 55% w/w, at least about 60% w/w, or at least about 65% w/w. In particular, single ring naphthenes can represent at least about 30% w/w of the total amount of naphthenes or at least about 50% w/w of the total amount of naphthenes. Additionally or alternatively, single ring naphthenes may represent at most about 65% w/w of the total amount of naphthenes, for example at most about 60% w/w, at most about 55% w/w, at most about 50% w/w, at most about 45% w/w, at most about 40% w/w, at most about 35% w/w, or at most about 30% w/w. Further additionally or alternatively, single ring naphthenes may represent about 30% w/w to about 65% w/w of the total amount of naphthenes, for example about 30% w/w to about 60% w/w, about 30% w/w to about 55% w/w, about 30% w/w to about 50% w/w, about 30% w/w to about 45% w/w, about 30% w/w to about 40% w/w, about 30% w/w to about 35% w/w, about 35% w/w to about 65% w/w, about 35% w/w to about 60% w/w, about 35% w/w to about 55% w/w, about 35% w/w to about 50% w/w, about 35% w/w to about 45% w/w, about 35% w/w to about 40% w/w, about 40% w/w to about 65% w/w, about 40% w/w to about 60% w/w, about 40% w/w to about 55% w/w, about 40% w/w to about 50% w/w, about 40% w/w to about 45% w/w, about 45% w/w to about 65% w/w, about 45% w/w to about 60% w/w, about 45% w/w to about 55% w/w, about 45% w/w to about 50% w/w, about 50% w/w to about 65% w/w, about 50% w/w to about 60% w/w, about 50% w/w to about 55% w/w, about 55% w/w to about 65% w/w, about 55% w/w to about 60% w/w, or about 60% w/w to about 65% w/w. In particular, the single ring naphthenes may represent about 30% w/w to about 65% w/w of the total amount of naphthenes, about 35% w/w to about 60% w/w, or about 35% w/w to about 55% w/w. Still further additionally or alternatively, the distillate composition may exhibit a w/w ratio of single ring naphthenes to total naphthenes of about 1:3, about 5:14, about 2:5, about 2:3, about 5:8, or about 5:7. In particular, the single ring naphthenes to total naphthenes w/w ratio can be from about 1:3 to about 5:7, from about 5:14 to about 5:7, or from about 2:5 to about 5:8.

In various aspects, multi-ring naphthenes may represent at least about 10% w/w of the total amount of naphthenes, for example at least about 15% w/w, at least about 20% w/w, at least about 25% w/w, at least about 30% w/w, at least about 35% w/w, at least about 40% w/w, at least about 45% w/w, at least about 50% w/w, at least about 55% w/w, at least about 60% w/w, or at least about 65% w/w. In particular, multi-ring naphthenes can represent at least about 20% w/w of the total amount of naphthenes or at least about 50% w/w of the total amount of naphthenes. Additionally or alternatively, multi-ring naphthenes may represent at most about 65% w/w of the total amount of naphthenes, e.g., at most about 60% w/w, at most about 55% w/w, at most about 50% w/w, at most about 45% w/w, at most about 40% w/w, at most about 35% w/w, at most about 30% w/w, at most about 25% w/w, at most about 20% w/w, at most about 15% w/w, or at most about 10% w/w. Further additionally or alternatively, multi-ring naphthenes may represent about 10% w/w to about 65% w/w of the total amount of naphthenes, for example about 10% w/w to about 60% w/w, about 10% w/w to about 55% w/w, about 10% w/w to about 50% w/w, about 10% w/w to about 45% w/w, about 10% w/w to about 40% w/w, about 10% w/w to about 35% w/w, about 10% w/w to about 30% w/w, about 10% w/w to about 25% w/w, about 10% w/w to about 20% w/w, about 10% w/w to about 15% w/w, about 15% w/w to about 65% w/w, about 15% w/w to about 60% w/w, about 15% w/w to about 55% w/w, about 15% w/w to about 50% w/w, about 15% w/w to about 45% w/w, about 15% w/w to about 40% w/w, about 15% w/w to about 35% w/w, about 15% w/w to about 30% w/w, about 15% w/w to about 25% w/w, about 15% w/w to about 20% w/w, about 20% w/w to about 65% w/w, about 20% w/w to about 60% w/w, about 20% w/w to about 55% w/w, about 20% w/w to about 50% w/w, about 20% w/w to about 45% w/w, about 20% w/w to about 40% w/w, about 20% w/w to about 35% w/w, about 20% w/w to about 30% w/w, about 20% w/w to about 25% w/w, about 25% w/w to about 65% w/w, about 25% w/w to about 60% w/w, about 25% w/w to about 55% w/w, about 25% w/w to about 50% w/w, about 25% w/w to about 45% w/w, about 25% w/w to about 40% w/w, about 25% w/w to about 35% w/w, about 25% w/w to about 30% w/w, about 30% w/w to about 65% w/w, about 30% w/w to about 60% w/w, about 30% w/w to about 55% w/w, about 30% w/w to about 50% w/w, about 30% w/w to about 45% w/w, about 30% w/w to about 40% w/w, about 30% w/w to about 35% w/w, about 35% w/w to about 65% w/w, about 35% w/w to about 60% w/w, about 35% w/w to about 55% w/w, about 35% w/w to about 50% w/w, about 35% w/w to about 45% w/w, about 35% w/w to about 40% w/w, about 40% w/w to about 65% w/w, about 40% w/w to about 60% w/w, about 40% w/w to about 55% w/w, about 40% w/w to about 50% w/w, about 40% w/w to about 45% w/w, about 45% w/w to about 65% w/w, about 45% w/w to about 60% w/w, about 45% w/w to about 55% w/w, about 45% w/w to about 50% w/w, about 50% w/w to about 65% w/w, about 50% w/w to about 60% w/w, about 50% w/w to about 55% w/w, about 55% w/w to about 65% w/w, about 55% w/w to about 60% w/w, or about 60% w/w to about 65% w/w. In particular, the single multi-ring naphthenes may represent about 10% w/w to about 65% w/w of the total amount of naphthenes, e.g., about 25% w/w to about 60% w/w or about 35% w/w to about 55% w/w. Still further additionally or alternatively, multi-ring naphthenes may be present in a w/w ratio, relative to total naphthenes, of about 1:10, for example about 1:5, about 1:3, about 5:14, about 2:5, about 2:3, about 5:8, or about 5:7. In particular, the multi-ring naphthenes to total naphthenes ratio w/w may be from about 1:10 to about 5:7, e.g., from about 1:3 to about 5:7 or from about 2:5 to about 5:8.

Additionally or alternatively, single-ring naphthenes may be present in a w/w ratio, relative to total naphthenes, of about 3:7, about 2:3, about 1:1, about 3:2, or about 5:2. In particular, the single ring naphthenes to multi-ring naphthenes ratio w/w may be from about 3:7 to about 5:2, for example from about 2:3 to about 5:2 or from about 2:3 to about 3:2.

Additionally or alternatively, when two-ring naphthenes are present in the distillate composition, the two-ring naphthenes may represent at least about 25% w/w of the total amount of naphthenes, for example at least about 30% w/w, at least about 35% w/w, at least about 40% w/w, or at least about 45% w/w. Further additionally or alternatively, when two-ring naphthenes are present in the distillate composition, the two-ring naphthenes may represent at most about 45% w/w of the total amount of naphthenes, for example at most about 40% w/w, at most about 35% w/w, at most about 30% w/w, or at most about 25% w/w. Additionally or alternatively, when two-ring naphthenes are present in the distillate composition, the two-ring naphthenes may represent about 25% w/w to about 45% w/w of the total amount of naphthenes, for example about 25% w/w to about 40% w/w, about 25% w/w to about 35% w/w, about 25% w/w to about 30% w/w, about 30% w/w to about 45% w/w, about 30% w/w to about 40% w/w, about 30% w/w to about 35% w/w, about 35% w/w to about 45% w/w, about 35% w/w to about 40% w/w, or about 40% w/w to about 45% w/w. In particular, two-ring naphthenes may represent about 25% w/w to about 45% w/w of the total amount of naphthenes, e.g., about 30% w/w to about 45% w/w or about 30% w/w to about 40% w/w.

Additionally or alternatively, when three-ring naphthenes are present in the distillate composition, the three-ring naphthenes may represent at least about 8.0% w/w of the total amount of naphthenes, for example at least about 10% w/w, at least about 12% w/w, at least about 14% w/w, or at least about 16% w/w. Further additionally or alternatively, when three-ring naphthenes are present in the distillate composition, the three-ring naphthenes may represent at most about 16% w/w of the total amount of naphthenes, for example at most about 14% w/w, at most about 12% w/w, at most about 10% w/w, or at most about 8.0% w/w. Still further additionally or alternatively, when three-ring naphthenes are present in the distillate composition, the three-ring naphthenes may represent about 8.0% w/w to about 16% w/w of the total amount of naphthenes, for example about 8.0% w/w to about 14% w/w, about 8.0% w/w to about 12% w/w, about 8.0% w/w to about 10% w/w, about 10% w/w to about 16% w/w, about 10% w/w to about 14% w/w, about 10% w/w to about 12% w/w, about 12% w/w to about 16% w/w, about 12% w/w to about 14% w/w, or about 14% w/w to about 16% w/w. In particular, three-ring naphthenes may represent about 8.0% w/w to about 16% w/w of the total amount of naphthenes, e.g., about 10% w/w to about 16% w/w or about 10% w/w to about 14% w/w.

Additionally or alternatively, when four-ring naphthenes are present in the distillate composition, the four-ring naphthenes may represent at least about 2.0% w/w of the total amount of naphthenes, for example at least about 4.0% w/w, at least about 6.0% w/w, at least about 8.0% w/w, or at least about 10% w/w. Further additionally or alternatively, when four-ring naphthenes are present in the distillate composition, the four-ring naphthenes may represent at most about 10% w/w of the total amount of naphthenes, for example at most about 8.0% w/w, at most about 6.0% w/w, at most about 4.0% w/w, or at most about 2.0% w/w. Still further additionally or alternatively, when four-ring naphthenes are present in the distillate composition, the four-ring naphthenes may represent about 2.0% w/w to about 10% w/w of the total amount of naphthenes, for example about 2.0% w/w to about 8.0% w/w, about 2.0% w/w to about 6.0% w/w, about 2.0% w/w to about 4.0% w/w, about 4.0% w/w to about 10% w/w, about 4.0% w/w to about 8.0% w/w, about 4.0% w/w to about 6.0% w/w, about 6.0% w/w to about 10% w/w, about 6.0% w/w to about 8.0% w/w, or about 8.0% w/w to about 10% w/w. In particular, four-ring naphthenes may represent about 2.0% w/w to about 10% w/w of the total amount of naphthenes, for example about 2.0% w/w to about 8.0% w/w or about 4.0% w/w to about 8.0% w/w.

Additionally or alternatively, when five-ring naphthenes are present in the distillate composition, the five-ring naphthenes may represent at least about 1.0% w/w of the total amount of naphthenes, for example at least about 1.4% w/w, at least about 1.8% w/w, at least about 2.2% w/w, or at least about 2.6% w/w. Further additionally or alternatively, when five-ring naphthenes are present in the distillate composition, the five-ring naphthenes may represent at most about 2.6% w/w of the total amount of naphthenes, for example at most 2.2% w/w, at most about 1.8% w/w, at most about 1.4% w/w, or at most about 1.0% w/w. Still further additionally or alternatively, when five-ring naphthenes are present in the distillate composition, the five-ring naphthenes may represent about 1.0% w/w to about 2.6% w/w of the total amount of naphthenes, for example about 1.0% w/w to about 2.2% w/w, about 1.0% w/w to about 1.8% w/w, about 1.0% w/w to about 1.4% w/w, about 1.4% why to about 2.6% w/w, about 1.4% w/w to about 2.2% w/w, about 1.4% w/w to about 1.8% w/w, about 1.8% w/w to about 2.6% w/w, about 1.8% w/w to about 2.2% w/w, or about 2.2% w/w to about 2.6% w/w. In particular, five-ring naphthenes may represent about 1.0% w/w to about 2.6% w/w of the total amount of naphthenes, e.g., about 1.4% w/w to about 2.6% w/w or about 1.4% w/w to about 2.2% w/w.

Additionally or alternatively, when six-ring naphthenes are present in the distillate composition, the six-ring naphthenes may represent at least about 0.20% w/w of the total amount of naphthenes, for example at least about 0.40% w/w, at least about 0.60% w/w, at least about 0.80% w/w, or at least about 1.0% w/w. Further additionally or alternatively, when six-ring naphthenes are present in the distillate composition, the six-ring naphthenes may represent at most about 1.0% w/w of the total amount of naphthenes, e.g., at most about 0.80% w/w, at most about 0.60% w/w, at most about 0.40% w/w, or at most about 0.20% w/w. Still further additionally or alternatively, when six-ring naphthenes are present in the distillate composition, the six-ring naphthenes may represent about 0.20% w/w to about 1.0% w/w of the total amount of naphthenes, e.g., about 0.20% w/w to about 0.80% w/w, about 0.20% w/w to about 0.60% w/w, about 0.20% w/w to about 0.40% w/w, about 0.40% w/w to about 1.0% w/w, about 0.40% w/w to about 0.80% w/w, about 0.40% w/w to about 0.60% w/w, about 0.60% w/w to about 1.0% w/w, about 0.60% w/w to about 0.80% w/w, or about 0.80% w/w to about 1.0% w/w. In particular, six-ring naphthenes may represent about 0.20% w/w to about 1.0% w/w of the total amount of naphthenes, e.g., about 0.20% w/w to about 0.80% w/w or about 0.40% to about 0.80%.

Additionally or alternatively, when single ring naphthenes and two-ring naphthenes are both present in the distillate composition, the sum of single ring naphthenes and two-ring naphthenes may represent at least about 50% w/w of the total amount of naphthenes, for example at least about 55% w/w, at least about 60% w/w, at least about 65% w/w, at least about 70% w/w, at least about 75% w/w, at least about 80% w/w, at least about 85% w/w, or at least about 90% w/w. In particular, in such situations, the sum of single ring naphthenes and two-ring naphthenes may represent at least about 60% w/w of the total amount of naphthenes. Further additionally or alternatively, when single ring naphthenes and two-ring naphthenes are present in the distillate composition, the sum of single ring naphthenes and two-ring naphthenes may represent at most about 90% of the total amount of naphthenes, at most about 85% w/w, at most about 80% w/w, at most about 75% w/w, at most about 70% w/w, at most about 65% w/w, at most about 60% w/w, at most about 55% w/w, or at most about 50% w/w. Still further additionally or alternatively, when single ring naphthenes and two-ring naphthenes are present in the distillate composition, the sum of single ring naphthenes and two-ring naphthenes may represent about 50% w/w to about 90% w/w of the total amount of naphthenes, e.g., about 50% w/w to about 85% w/w, about 50% w/w to about 80% w/w, about 50% w/w to about 75% w/w, about 50% w/w to about 70% w/w, about 50% w/w to about 65% w/w, about 50% w/w to about 60% w/w, about 50% w/w to about 55% w/w, about 55% w/w to about 90% w/w, about 55% w/w to about 85% w/w, about 55% w/w to about 80% w/w, about 55% w/w to about 75% w/w, about 55% w/w to about 70% w/w, about 55% w/w to about 65% w/w, about 55% w/w to about 60% w/w, about 60% w/w to about 90% w/w, about 60% w/w to about 85% w/w, about 60% w/w to about 80% w/w, about 60% w/w to about 75% w/w, about 60% w/w to about 70% w/w, about 60% w/w to about 65% w/w, about 65% w/w to about 90% w/w, about 65% w/w to about 85% w/w, about 65% w/w to about 80% w/w, about 65% w/w to about 75% w/w, about 65% w/w to about 70% w/w, about 70% w/w to about 90% w/w, about 70% w/w to about 85% w/w, about 70% w/w to about 80% w/w, about 70% w/w to about 75% w/w, about 75% w/w to about 90% w/w, about 75% w/w to about 85% w/w, about 75% w/w to about 80% w/w, about 80% w/w to about 90% w/w, about 80% w/w to about 85% w/w, or about 85% w/w to about 90% w/w.

Additionally or alternatively, when four-ring naphthenes, five-ring naphthenes and/or six-ring naphthenes are present in the distillate composition, the sum of four-ring, five-ring, and six-ring naphthenes may represent at least about 1.0% w/w of the total amount of naphthenes, e.g., at least about 2.0% w/w, at least about 5.0% w/w, at least about 7.0% w/w, at least about 10% w/w, at least about 12% w/w, at least about 15% w/w, or at least about 20% w/w. Further additionally or alternatively, when four-ring naphthenes, five-ring naphthenes and/or six-ring naphthenes are present in the distillate composition, the sum of four-ring, five-ring, and six-ring naphthenes may represent at most about 20% w/w of the total amount of naphthenes, e.g., at most about 15% w/w, at most about 12% w/w, at most about 10% w/w, at most about 7.0% w/w, at most about 5.0% w/w, at most about 2.0% w/w, or at most about 1.0% w/w. Still further additionally or alternatively, when four-ring naphthenes, five-ring naphthenes and/or six-ring naphthenes are present in the distillate composition, the sum of four-ring, five-ring, and six-ring naphthenes may represent about 1.0% w/w to about 20% w/w of the total amount of naphthenes, e.g., about 1.0% w/w to about 15% w/w, about 1.0% w/w to about 12% w/w, about 1.0% w/w to about 10% w/w, about 1.0% w/w to about 7.0% w/w, about 1.0% w/w to about 5.0% w/w, about 1.0% w/w to about 2.0% w/w, about 2.0% w/w to about 20% w/w, about 2.0% w/w to about 15% w/w, about 2.0% w/w to about 12% w/w, about 2.0% w/w to about 10% w/w, about 2.0% w/w to about 7.0% w/w, about 2.0% w/w to about 5.0% w/w, about 5.0% w/w to about 20% w/w, about 5.0% w/w to about 15% w/w, about 5.0% w/w to about 12% w/w, about 5.0% w/w to about 10% w/w, about 5.0% w/w to about 7.0% w/w, about 7.0% w/w to about 20% w/w, about 7.0% w/w to about 15% w/w, about 7.0% w/w to about 12% w/w, about 7.0% w/w to about 10% w/w, about 10% w/w to about 20% w/w, about 10% w/w to about 15% w/w, about 10% w/w to about 12% w/w, about 12% w/w to about 20% w/w, about 12% w/w to about 15% w/w, or about 15% w/w to about 20% w/w. In particular, the sum of four-ring, five-ring, and six-ring naphthenes may represent about 1.0% w/w to about 20% w/w of the total amount of naphthenes, for example about 2.0% w/w to about 17% w/w or about 5.0% w/w to about 12% w/w.

In an embodiment, the distillate composition may have one or more of the following: (i) four-ring naphthenes present in an amount of about 2.0% w/w to about 10% w/w of the total amount of naphthenes; (ii) five-ring naphthenes present in an amount of about 1.0% w/w to about 2.6% w/w of the total amount of naphthenes; and (iii) six-ring naphthenes present in an amount of about 0.20% to about 1.0% w/w of the total amount of naphthenes. Additionally or alternatively, the distillate composition may have at least two of (i)-(iii) or all of (i)-(iii). For example, the distillate composition may satisfy: (i) and (ii); (i) and (iii); (ii) and (iii); or (i), (ii) and (iii).

II.B. Non-Cyclic Paraffins

In various aspects, the distillate composition may comprise non-cyclic paraffins. In particular, the non-cyclic paraffins may be present in the distillate composition in an amount of at least about 5.0 wt %, e.g., at least about 10 wt %, at least about 15 wt %, at least about 20 wt %, at least about 25 wt %, at least about 30 wt %, at least about 35 wt %, at least about 40 wt %, at least about 45 wt %, at least about 50 wt %, at least about 55 wt %, at least about 60 wt %, at least about 65 wt %, or at least about 70 wt %. Additionally or alternatively, non-cyclic paraffins may be present in the distillate composition in an amount of at most about 70 wt %, at most about 65 wt %, at most about 60 wt %, at most about 55 wt %, at most about 50 wt %, at most about 45 wt %, at most about 40 wt %, at most about 35 wt %, at most about 30 wt %, at most about 25 wt %, at most about 20 wt %, at most about 15 wt %, at most about 10 wt %, or at most about 5.0 wt %. Further additionally or alternatively, non-cyclic paraffins may be present in the distillate composition in an amount of about 5.0 wt % to about 70 wt %, for example about 5.0 wt % to about 65 wt %, 5.0 wt % to about 60 wt %, about 5.0 wt % to about 55 wt %, about 5.0 wt % to about 50 wt %, about 5.0 wt % to about 45 wt %, about 5.0 wt % to about 40 wt %, about 5.0 wt % to about 35 wt %, about 5.0 wt % to about 30 wt %, about 5.0 wt % to about 25 wt %, about 5.0 wt % to about 20 wt %, about 5.0 wt % to about 15 wt %, about 10 wt % to about 70 wt %, about 10 wt % to about 65 wt %, about 10 wt % to about 60 wt %, about 10 wt % to about 55 wt %, about 10 wt % to about 50 wt %, about 10 wt % to about 45 wt %, about 10 wt % to about 40 wt %, about 10 wt % to about 35 wt %, about 10 wt % to about 30 wt %, about 10 wt % to about 25 wt %, about 10 wt % to about 20 wt %, about 10 wt % to about 15 wt %, about 15 wt % to about 70 wt %, about 15 wt % to about 65 wt %, about 15 wt % to about 60 wt %, about 15 wt % to about 55 wt %, about 15 wt % to about 50 wt %, about 15 wt % to about 45 wt %, about 15 wt % to about 40 wt %, about 15 wt % to about 35 wt %, about 15 wt % to about 30 wt %, about 15 wt % to about 25 wt %, about 15 wt % to about 20 wt %, about 20 wt % to about 70 wt %, about 20 wt % to about 65 wt %, about 20 wt % to about 60 wt %, about 20 wt % to about 55 wt %, about 20 wt % to about 50 wt %, about 20 wt % to about 45 wt %, about 20 wt % to about 40 wt %, about 20 wt % to about 35 wt %, about 20 wt % to about 30 wt %, about 20 wt % to about 25 wt %, about 25 wt % to about 70 wt %, about 25 wt % to about 65 wt %, about 25 wt % to about 60 wt %, about 25 wt % to about 55 wt %, about 25 wt % to about 50 wt %, about 25 wt % to about 45 wt %, about 25 wt % to about 40 wt %, about 25 wt % to about 35 wt %, about 25 wt % to about 30 wt %, about 30 wt % to about 70 wt %, about 30 wt % to about 65 wt %, about 30 wt % to about 60 wt %, about 30 wt % to about 55 wt %, about 30 wt % to about 50 wt %, about 30 wt % to about 45 wt %, about 30 wt % to about 40 wt %, about 30 wt % to about 35 wt %, about 35 wt % to about 70 wt %, about 35 wt % to about 65 wt %, about 35 wt % to about 60 wt %, about 35 wt % to about 55 wt %, about 35 wt % to about 50 wt %, about 35 wt % to about 45 wt %, about 35 wt % to about 40 wt %, about 40 wt % to about 70 wt %, about 40 wt % to about 65 wt %, about 40 wt % to about 60 wt %, about 40 wt % to about 55 wt %, about 40 wt % to about 50 wt %, about 40 wt % to about 45 wt %, about 45 wt % to about 70 wt %, about 45 wt % to about 65 wt %, about 45 wt % to about 60 wt %, about 45 wt % to about 55 wt %, about 45 wt % to about 50 wt %, about 50 wt % to about 70 wt %, about 50 wt % to about 65 wt %, about 50 wt % to about 60 wt %, about 50 wt % to about 55 wt %, about 55 wt % to about 70 wt %, about 55 wt % to about 65 wt %, about 55 wt % to about 60 wt %, about 60 wt % to about 70 wt %, about 60 wt % to about 65 wt %, or about 65 wt % to about 70 wt %. In particular, non-cyclic paraffins may be present in the distillate composition in an amount of about 5.0 wt % to about 70 wt %, e.g., about 10 wt % to about 60 wt % or about 20 wt % to about 50 wt %.

In various aspects, the distillate composition may comprise isoparaffins. The isoparaffins may be present in the distillate composition an amount of at least about 5.0 wt %, for example at least about 10 wt %, at least about 15 wt %, at least about 20 wt %, at least about 25 wt %, at least about 30 wt %, at least about 35 wt %, at least about 40 wt %, at least about 45 wt %, at least about 50 wt %, at least about 55 wt %, or at least about 60 wt %. Additionally or alternatively, isoparaffins may be present in the distillate composition an amount of at most about 60 wt %, for example at most about 55 wt %, at most about 50 wt %, at most about 45 wt %, at most about 40 wt %, at most about 35 wt %, at most about 30 wt %, at most about 25 wt %, at most about 20 wt %, at most about 15 wt %, at most about 10 wt %, or at most about 5.0 wt %. Further additionally or alternatively, isoparaffins may be present in the distillate composition an amount of about 5.0 wt % to about 60 wt %, e.g., about 5.0 wt % to about 55 wt %, about 5.0 wt % to about 50 wt %, about 5.0 wt % to about 45 wt %, about 5.0 wt % to about 40 wt %, about 5.0 wt % to about 35 wt %, about 5.0 wt % to about 30 wt %, about 5.0 wt % to about 25 wt %, about 5.0 wt % to about 20 wt %, about 5.0 wt % to about 15 wt %, about 10 wt % to about 60 wt %, about 10 wt % to about 55 wt %, about 10 wt % to about 50 wt %, about 10 wt % to about 45 wt %, about 10 wt % to about 40 wt %, about 10 wt % to about 35 wt %, about 10 wt % to about 30 wt %, about 10 wt % to about 25 wt %, about 10 wt % to about 20 wt %, about 10 wt % to about 15 wt %, about 15 wt % to about 60 wt %, about 15 wt % to about 55 wt %, about 15 wt % to about 50 wt %, about 15 wt % to about 45 wt %, about 15 wt % to about 40 wt %, about 15 wt % to about 35 wt %, about 15 wt % to about 30 wt %, about 15 wt % to about 25 wt %, about 15 wt % to about 20 wt %, about 20 wt % to about 60 wt %, about 20 wt % to about 55 wt %, about 20 wt % to about 50 wt %, about 20 wt % to about 45 wt %, about 20 wt % to about 40 wt %, about 20 wt % to about 35 wt %, about 20 wt % to about 30 wt %, about 20 wt % to about 25 wt %, about 25 wt % to about 60 wt %, about 25 wt % to about 55 wt %, about 25 wt % to about 50 wt %, about 25 wt % to about 45 wt %, about 25 wt % to about 40 wt %, about 25 wt % to about 35 wt %, about 25 wt % to about 30 wt %, about 30 wt % to about 60 wt %, about 30 wt % to about 55 wt %, about 30 wt % to about 50 wt %, about 30 wt % to about 45 wt %, about 30 wt % to about 40 wt %, about 30 wt % to about 35 wt %, about 35 wt % to about 60 wt %, about 35 wt % to about 55 wt %, about 35 wt % to about 50 wt %, about 35 wt % to about 45 wt %, about 35 wt % to about 40 wt %, about 40 wt % to about 60 wt %, about 40 wt % to about 55 wt %, about 40 wt % to about 50 wt %, about 40 wt % to about 45 wt %, about 45 wt % to about 60 wt %, about 45 wt % to about 55 wt %, about 45 wt % to about 50 wt %, about 50 wt % to about 60 wt %, about 50 wt % to about 55 wt %, or about 55 wt % to about 60 wt %. In particular, isoparaffins may be present in the distillate composition an amount of about 5.0 wt % to about 60 wt %, such as about 10 wt % to about 50 wt % or about 20 wt % to about 50 wt %.

In certain embodiments, the distillate composition may comprise at least about 50 wt % naphthenes and about 10 wt % to about 50 wt % isoparaffins.

Additionally or alternatively, the distillate composition may further comprise n-paraffins in an amount of about 20 wt % or less, about 15 wt % or less, about 10 wt % or less, about 8.0 wt % or less, about 6.0 wt % or less, about 5.0 wt % or less, or about 2.0 wt % or less. In particular, the distillate composition can comprise n-paraffins in an amount of about 10 wt % or less, e.g., about 8.0 wt % or less, or about 6.0 wt % or less. Further additionally or alternatively, the distillate composition may further comprise n-paraffins in an amount of about 2.0 wt % to about 20 wt %, e.g., about 2.0 wt % to about 15 wt %, about 2.0 wt % to about 10 wt %, about 2.0 wt % to about 8.0 wt %, about 2.0 wt % to about 6.0 wt %, about 2.0 wt % to about 5.0 wt %, about 5.0 wt % to about 20 wt %, about 5.0 wt % to about 15 wt %, about 5.0 wt % to about 10 wt %, about 5.0 wt % to about 8.0 wt %, about 5.0 wt % to about 6.0 wt %, about 6.0 wt % to about 20 wt %, about 6.0 wt % to about 15 wt %, about 6.0 wt % to about 10 wt %, about 6.0 wt % to about 8.0 wt %, about 8.0 wt % to about 20 wt %, about 8.0 wt % to about 15 wt %, about 8.0 wt % to about 10 wt %, about 10 wt % to about 20 wt %, about 10 wt % to about 15 wt %, or about 15 wt % to about 20 wt %. Additionally or alternatively, when n-paraffins are present in the distillate composition, the n-paraffins may represent about 30 wt % or less of the total amount of non-cyclic paraffins, e.g., about 25 wt % or less, about 20 wt % or less, about 15 wt % or less, or about 10 wt % or less. In particular, the n-paraffins may represent about 25 wt % or less of the total amount of non-cyclic paraffins, or about 20 wt % or less. Further additionally or alternatively, when n-paraffins are present in the distillate composition, the n-paraffins may represent about 10 wt % to about 30 wt % of the total amount of non-cyclic paraffins, e.g., about 10 wt % to about 25 wt %, about 10 wt % to about 20 wt %, about 10 wt % to about 15 wt %, about 15 wt % to about 30 wt %, about 15 wt % to about 25 wt %, about 15 wt % to about 20 wt %, about 20 wt % to about 30 wt %, about 20 wt % to about 25 wt %, or about 25 wt % to about 30 wt %. In particular, N-paraffins may represent about 10 wt % to about 30 wt % of the total amount of non-cyclic paraffins, e.g., about 10 wt % to about 25 wt % or about 15 wt % to about 20 wt %.

II.C. Aromatics

In various aspects, the distillate composition may comprise aromatics. In certain embodiments, the distillate composition may comprise aromatics in an amount of about 10 wt % or less, e.g., about 5.0 wt % or less, about 2.5 wt % or less, about 1.5 wt % or less, about 1.0 wt % or less, about 0.50 wt % or less, or about 0.01 wt % or less. Additionally or alternatively, the distillate may contain substantially no aromatics. In particular, the distillate composition can comprise aromatics in an amount of about 5.0 wt % or less, e.g., about 1.5 wt % or less or about 1.0 wt % or less. Further additionally or alternatively, the distillate may include aromatics in an amount of about 0.010 wt % to about 10 wt %, e.g., about 0.010 wt % to about 5.0 wt %, about 0.010 wt % to about 2.5 wt %, about 0.010 wt % to about 1.5 wt %, about 0.010 wt % to about 1.0 wt %, about 0.010 wt % to about 0.50 wt %, about 0.50 wt % to about 10 wt %, about 0.50 wt % to about 5.0 wt %, about 0.50 wt % to about 2.5 wt %, about 0.50 wt % to about 1.5 wt %, about 0.50 wt % to about 1.0 wt %, about 1.0 wt % to about 10 wt %, about 1.0 wt % to about 5.0 wt %, about 1.0 wt % to about 2.5 wt %, about 1.0 wt % to about 1.5 wt %, about 1.5 wt % to about 10 wt %, about 1.5 wt % to about 5.0 wt %, about 1.5 wt % to about 2.5 wt %, about 2.5 wt % to about 10 wt %, about 2.5 wt % to about 5.0 wt %, or about 5.0 wt % to about 10 wt %.

In some embodiments, the distillate composition may comprise at least about 50 wt % naphthenes, less than about 1.5 wt % aromatics, and about 10 wt % to about 50 wt % isoparaffins.

II.D. Sulfur

In various aspects, the distillate composition may comprise sulfur. In certain embodiments, the distillate composition may comprise about 100 wppm or less sulfur, e.g., about 50 wppm or less, about 10 wppm or less, about 5 wppm or less, about 3 wppm or less, or about 1 wppm or less. Additionally or alternatively, the distillate may include substantially no sulfur. In particular, the distillate composition can comprise sulfur in an amount of about 10 wppm or less, e.g. about 5 wppm or less or about 3 wppm or less. Further additionally or alternatively, the distillate may include sulfur in an amount of about 1 wppm to about 100 wppm, about 1 wppm to about 50 wppm, about 1 wppm to about 10 wppm, about 1 wppm to about 5 wppm, about 1 wppm to about 3 wppm, about 3 wppm to about 100 wppm, about 3 wppm to about 50 wppm, about 3 wppm to about 10 wppm, about 3 wppm to about 5 wppm, about 5 wppm to about 100 wppm, about 5 wppm to about 50 wppm, about 5 wppm to about 10 wppm, about 10 wppm to about 100 wppm, about 10 wppm to about 50 wppm, or about 50 wppm to about 100 wppm.

II.E. Distillate Composition Properties

Advantageously, the distillate compositions described herein, in combination with the above-described compositional properties, can also exhibit combinations of various physical/performance properties that can render the distillate composition useful, e.g., on its own and/or for blending with various refinery streams to produce finished products, such as diesel boiling-range fuel, to meet required industry standards. These combinations of physical/performance properties were surprising (not predicted) for such naphthene-containing distillate compositions, as more fully described herein.

In various aspects, the distillate composition may have a viscosity (measured according to ASTM D445) at a temperature of about 100° C. to about 200° C. of about 0.50 cSt to about 0.008 cSt, e.g., about 0.48 cSt to about 0.01 cSt or about 0.45 cSt to about 0.011 cSt. Additionally or alternatively, the distillate composition may exhibit a change in viscosity (measured according to ASTM D445) at a temperature of about 100° C. to about 200° C. of greater than about 0.400 cSt, for example at least about 0.405 cSt, at least about 0.410 cSt, at least about 0.415 cSt, at least about 0.420 cSt, at least about 0.425 cSt, or at least about 0.430 cSt. In particular, the distillate composition may exhibit a change in viscosity at a temperature of about 100° C. to about 200° C. of greater than about 0.400 cSt, e.g., of at least about 0.415 cSt. Further additionally or alternatively, the distillate composition may exhibit a change in viscosity (measured according to ASTM D445) at a temperature of about 100° C. to about 200° C. of about 0.400 cSt to about 0.430 cSt, for example about 0.400 cSt to about 0.425 cSt, about 0.400 cSt to about 0.420 cSt, about 0.400 cSt to about 0.415 cSt, about 0.400 cSt to about 0.410 cSt, about 0.400 cSt to about 0.405 cSt, about 0.405 cSt to about 0.430 cSt, about 0.405 cSt to about 0.425 cSt, about 0.405 cSt to about 0.420 cSt, about 0.405 cSt to about 0.415 cSt, about 0.405 cSt to about 0.410 cSt, about 0.410 cSt to about 0.430 cSt, about 0.410 cSt to about 0.425 cSt, about 0.410 cSt to about 0.420 cSt, about 0.410 cSt to about 0.415 cSt, about 0.415 cSt to about 0.430 cSt, about 0.415 cSt to about 0.425 cSt, about 0.415 cSt to about 0.420 cSt, about 0.420 cSt to about 0.430 cSt, about 0.420 cSt to about 0.425 cSt, or about 0.425 cSt to about 0.430 cSt. In particular, the distillate composition may exhibit a change in viscosity at a temperature of about 100° C. to about 200° C. of about 0.400 cSt to about 0.430 cSt, e.g., about 0.405 cSt to about 0.430 cSt, about 0.405 cSt to about 0.425 cSt, or about 0.410 cSt to about 0.425 cSt.

As discussed above, the distillate composition described herein may be used as a fuel in neat form. However used in a fuel, the distillate composition described herein may advantageously result in increased fuel economy and/or in lower emissions, e.g., due the above-described viscosity. For example, in diesel engines, fuel injection temperatures can typically range between about 100° C. and about 200° C. (e.g., about 125° C. and about 180° C.). Thus, lower viscosity at higher temperatures (e.g., about 100° C. to about 200° C.), as well as a substantial change in viscosity as temperature increases (i.e., a low viscosity index), can be important, for instance because lower viscosity can result in a finer stream of fuel with a better spray that can better mix with air, leading to better combustion thereby resulting in higher efficiency, higher power output, improved fuel economy, and/or lower emissions. Not only can the distillate composition described herein exhibit low viscosity at about 100° C. to about 200° C. (e.g., about 0.50 cSt to about 0.0080 cSt), the distillate composition can additionally or alternatively exhibit a low viscosity index at about 100° C. to about 200° C. (e.g., a change in viscosity of greater than about 0.400 cSt), thereby resulting in a distillate composition with increased fuel economy and/or lower emissions.

In various aspects, the distillate composition may exhibit a cetane number (measured according to ASTM D7668), optionally in combination with the above-described viscosity, of at least about 30, e.g., at least about 35, at least about 40, at least about 45, at least about 50, at least about 55, at least about 60, at least about 65, or at least about 70. Additionally or alternatively, the distillate composition may exhibit a cetane number, optionally in combination with the above-described viscosity, of at most about 70, at most about 65, at most about 50, at most about 45, at most about 40, at most about 35, at most about 30, at most about 35, or at most about 30. Additionally or alternatively, the distillate composition may exhibit a cetane number, optionally in combination with the above-described viscosity, of about 30 to about 70, about 30 to about 65, about 30 to about 60, about 30 to about 55, about 30 to about 50, about 30 to about 45, about 30 to about 40, about 30 to about 35, about 35 to about 70, about 35 to about 65, about 35 to about 60, about 35 to about 55, about 35 to about 50, about 35 to about 45, about 35 to about 40, about 40 to about 70, about 40 to about 65, about 40 to about 60, about 40 to about 55, about 40 to about 50, about 40 to about 45, about 45 to about 70, about 45 to about 65, about 45 to about 60, about 45 to about 55, about 45 to about 50, about 50 to about 70, about 50 to about 65, about 50 to about 60, about 50 to about 55, about 55 to about 70, about 55 to about 65, about 55 to about 60, about 60 to about 70, about 60 to about 65, or about 65 to about 70. In particular, the distillate composition may exhibit a cetane number of about 30 to about 70, about 40 to about 65, or about 50 to about 65.

In various aspects, the distillate composition may exhibit a smoke point (measured according to ASTM D1322), optionally in combination with the above-described viscosity and/or cetane number, of at least about 15 mm, e.g., at least about 18 mm, at least about 19 mm, at least about 20 mm, at least about 22 mm, at least about 25 mm, at least about 28 mm, at least about 30 mm, at least about 32 mm, or at least about 35 mm. Additionally or alternatively, the distillate composition may have a smoke point, optionally in combination with the above-described viscosity and/or cetane number, of at most about 35 mm, e.g., at most about 32 mm, at most about 30 mm, at most about 28 mm, at most about 25 mm, at most about 22 mm, at most about 20 mm, at most about 19 mm, at most about 18 mm, or at most about 15 mm. Further additionally or alternatively, the distillate composition may have a smoke point, optionally in combination with the above-described viscosity and/or cetane number, of about 15 mm to about 35 mm, e.g., about 15 mm to about 32 mm, about 15 mm to about 30 mm, about 15 mm to about 28 mm, about 15 mm to about 25 mm, about 15 mm to about 22 mm, about 15 mm to about 20 mm, about 18 mm to about 35 mm, about 18 mm to about 32 mm, about 18 mm to about 30 mm, about 18 mm to about 28 mm, about 18 mm to about 25 mm, about 18 mm to about 22 mm, about 18 mm to about 20 mm, about 19 mm to about 35 mm, about 19 mm to about 32 mm, about 19 mm to about 30 min, about 19 mm to about 28 min, about 19 mm to about 25 mm, about 19 mm to about 22 mm, about 20 mm to about 35 mm, about 20 mm to about 32 mm, about 20 mm to about 30 mm, about 20 mm to about 28 mm, about 20 mm to about 25 mm, about 20 mm to about 22 mm, about 22 mm to about 35 mm, about 22 mm to about 32 mm, about 22 mm to about 30 mm, about 22 mm to about 28 mm, about 22 mm to about 25 mm, about 25 mm to about 35 mm, about 25 mm to about 32 min, about 25 mm to about 30 mm, about 25 mm to about 28 mm, about 28 mm to about 35 mm, about 28 mm to about 32 mm, about 28 mm to about 30 mm, about 30 to about 32, about 30 to about 35 or about 32 to about 35. In particular, the distillate composition, optionally in combination with the above-described viscosity and/or cetane number, may have a smoke point of about 15 mm to about 35, about 22 mm to about 35 mm, about 25 to about 32 mm, or about 28 mm to about 32 mm.

In various aspects, the distillate composition may exhibit a cloud point (measured according to ASTM D5771), optionally in combination with the above-described viscosity, cetane number, and/or smoke point, of about −65° C. or less, e.g., about −60° C. or less, about −55° C. or less, about −50° C. or less, about −45° C. or less, about −40° C. or less, about −35° C. or less, about −30° C. or less, or about −25° C. or less. Additionally or alternatively, the distillate composition may exhibit a cloud point, optionally in combination with the above-described viscosity, cetane number, and/or smoke point, of about −65° C. to about −25° C., e.g., about −65° C. to about −30° C. about −65° C. to about −35° C., about −65° C. to about −40° C., about −65° C. to about −45° C., about −65° C. to about −50° C., about −65° C. to about −55° C., about −65° C. to about −60° C., about −60° C. to about −25° C., about −60° C. to about −30° C., about −60° C. to about −35° C., about −60° C. to about −40° C., about −65° C. to about −45° C., about −60° C. to about −50° C., about −60° C. to about −55° C., about −55° C. to about −25° C., about −55° C. to about −30° C., about −55° C. to about −35° C., about −55° C. to about −40° C., about −55° C. to about −45° C., about −55° C. to about −50° C., about −50° C. to about −25° C., about −50° C. to about −30° C., about −50° C. to about −35° C., about −50° C. to about −40° C., about −50° C. to about −45° C., about −45° C. to about −25° C., about −45° C. to about −30° C., about −45° C. to about −35° C., about −45° C. to about −40° C., about −40° C. to about −25° C., about −40° C. to about −30° C., about −40° C. to about −35° C., about −35° C. to about −25° C., about −35° C. to about −30° C., or about −30° C. to about −25° C. In particular, the distillate composition may exhibit a cloud point, optionally in combination with the above-described viscosity, cetane number and/or smoke point, of about −65° C. to about −25° C., e.g., about −60° C. to about −35° C. or about −60° C. to about −40° C.

In various aspects, the distillate composition may exhibit a cold filter plugging point (CFPP) (measured according to ASTM D6371), optionally in combination with the above-described viscosity, cetane number, smoke point, and/or cloud point, of about −40° C. or less, e.g., about −35° C. or less, about −30° C. or less, about −25° C. or less, about −22° C. or less, about −20° C. or less, or about −15° C. or less. Additionally or alternatively, the distillate composition may exhibit a cold filter plugging point, optionally in combination with the above-described viscosity, cetane number, smoke point, and/or cloud point, of about −40° C. to about −15° C., e.g., about −40° C. to about −20° C., about −40° C. to about −22° C., about −40° C. to about −25° C., about −40° C. to about −30° C., about −40° C. to about −35° C., about −35° C. to about −15° C., about −35° C. to about −20° C., about −35° C. to about −22° C., about −35° C. to about −25° C., about −35° C. to about −30° C., about −30° C. to about −15° C., about −30° C. to about −20° C., about −30° C. to about −22° C., about −30° C. to about −25° C., about −25° C. to about −15° C., about −25° C. to about −20° C., about −22° C. to about −15° C., about −22° C. to about −20° C., or about −20° C. to about −15° C. in particular, the distillate composition may exhibit a cold filter plugging point, optionally in combination with the above-described viscosity, cetane number, smoke point and/or cloud point, of about −40° C. to about −15° C., about −35° C. to about −15° C., about −30° C. to about −22° C. or about −30° C. to about −20° C.

In various aspects, the distillate composition may exhibit a volumetric energy content (measured according to ASTM D4809), optionally in combination with the above-described viscosity, cetane number, smoke point, cloud point, and/or cold filter plugging point, of at least about 125,000 BTU/gallon, e.g., at least about 127,000 BTU/gallon, at least about 131,000 BTU/gallon, at least about 133,000 BTU/gallon, at least about 135,000 BTU/gallon, at least about 137,000 BTU/gallon, or at least about 140,000 BTU/gallon. Additionally or alternatively, the distillate composition may exhibit a volumetric energy content, optionally in combination with the above-described viscosity, cetane number, smoke point, cloud point, and/or cold filter plugging point, of about 125,000 BTU/gallon to about 140,000 BTU/gallon, e.g., about 125,000 BTU/gallon to about 137,000 BTU/gallon, about 125,000 BTU/gallon to about 135,000 BTU/gallon, about 125,000 BTU/gallon to about 133,000 BTU/gallon, about 125,000 BTU/gallon to about 131,000 BTU/gallon, about 125,000 BTU/gallon to about 127,000 BTU/gallon, about 127,000 BTU/gallon to about 140,000 BTU/gallon, about 127,000 BTU/gallon to about 137,000 BTU/gallon, about 127,000 BTU/gallon to about 135,000 BTU/gallon, about 127,000 BTU/gallon to about 133,000 BTU/gallon, about 127,000 BTU/gallon to about 131,000 BTU/gallon, about 131,000 BTU/gallon to about 131,000 BTU/gallon, about 131,000 BTU/gallon to about 131,000 BTU/gallon, about 131,000 BTU/gallon to about 135,000 BTU/gallon, about 131,000 BTU/gallon to about 133,000 BTU/gallon, about 133,000 BTU/gallon to about 140,000 BTU/gallon, about 133,000 BTU/gallon to about 137,000 BTU/gallon, about 133,000 BTU/gallon to about 135,000 BTU/gallon, about 135,000 BTU/gallon to about 140,000 BTU/gallon, about 135,000 BTU/gallon to about 137,000 BTU/gallon, or about 137,000 BTU/gallon to about 140,000 BTU/gallon. In particular, the distillate composition may have a volumetric energy content, optionally in combination with the above-described cetane number, smoke point, cloud point or cold filter plugging point, of about 127,000 BTU/gallon to about 140,000 BTU/gallon, such as about 131,000 BTU/gallon to about 140,000 BTU/gallon, or about 133,000 BTU/gallon to about 140,000 BTU/gallon.

It could not have been predicted that the distribution of naphthenes in the distillate compositions described herein would have such a beneficial combination of physical and performance properties. Such a combination of properties is believed to be unexpected in the art, as it is generally known that desirable improvements in one property may result in concomitant undesirable reduction in one or more other properties. In any event, rarely to two properties that have some sort of correlation in a composition of matter both desirably get better with changes in that composition of matter—usually, the properties are trade-offs. For example, while hydrotreated vegetable oils (i.e., renewable diesel) can provide enhanced cetane numbers and cold flow properties (e.g., cloud point, cold filter plugging point), it can simultaneously exhibit low volumetric energy content. Thus, it was unexpected that the naphthene-containing distillate compositions described herein could simultaneously exhibit a high cetane number, along with a low cloud point and/or cold filter plugging point, and a high volumetric energy content, as describe above. Furthermore, increasing naphthene ring content is known to typically negatively affect viscosity (i.e., increase viscosity). However, the naphthene-containing distillate compositions described herein unexpectedly exhibit desirably low viscosity at temperatures of about 100° C. to about 200° C.

In certain embodiments, the distillate composition may exhibit at least one of the following properties: (i) a cetane number of at least about 50; (ii) a cloud point of less than about −40° C.; (iii) a cold filter plugging point of less than about −20° C.; (iv) a smoke point of at least about 25 mm; (v) a change in viscosity of greater than about 0.40 cSt between about 100° C. and about 200° C.; and (vi) a volumetric energy content of at least about 131,000 BTU/gallon. Additionally or alternatively, the distillate composition may exhibit at least two of properties (i)-(vi); for example, the distillate composition may exhibit properties: (i) and (ii); (i) and (iii); (i) and (iv); (i) and (v); (i) and (vi); (ii) and (iii); (ii) and (iv); (ii) and (v); (ii) and (vi); (iii) and (iv); (iii) and (v); (iii) and (vi); (iv) and (v); (iv) and (vi); or (v) and (vi). Further additionally or alternatively, the distillate composition may exhibit at least three of properties (i)-(vi); for example, the distillate composition may exhibit properties: (i), (ii) and (iii); (i), (ii) and (iv); (i) (ii) and (v); (i) (ii) and (vi); (i), (iii) and (iv); (i), (iii) and (v); (i), (iii) and (vi); (i), (iv) and (v); (i), (iv) and (vi); (i), (v) and (vi); (ii), (iii) and (iv); (ii), (iii) and (v); (ii), (iii) and (vi); (ii), (iv) and (v); (ii), (iv) and (vi); (ii), (v) and (vi); (iii), (iv) and (v); (iii), (iv) and (vi); (iii), (v) and (vi); or (iv), (v) and (vi). Yet further additionally or alternatively, the distillate composition may exhibit at least four of properties (i)-(vi); for example, the distillate composition may exhibit properties: (i), (ii), (iii) and (iv); (i), (ii), (iii) and (v); (i), (ii), (iii) and (vi); (ii), (iv) and (v); (i), (ii), (iv) and (vi); (i), (ii), (v) and (vi); (iv) and (v); (i), (iii), (iv), and (vi); (i), (iii), (v), and (vi); (i), (iv), (v) and (vi); (ii), (iii), (iv) and (v); (ii), (iii), (iv) and (vi); (ii), ((v) and (vi); (ii), (iv), (v) and (vi); or (iii), (iv), (v) and (vi). Yet still further additionally or alternatively, the distillate composition may exhibit at least five of properties (i)-(vi); for example, the distillate composition may exhibit properties: (i), (ii), (iii), (iv) and (v); (i), (ii), (iii), (iv) and (vi); (i), (ii), (iv), (v) and (vi); (i), (iii), (iv), (v) and (vi); or (ii), (iii), (iv), (v) and (vi). Yet even further additionally or alternatively, the distillate composition may exhibit all of properties (i)-(vi).

In certain embodiments, the distillate composition may comprise at least about 50 wt % naphthalenes; less than about 1.5 wt % aromatics; and less than about 5 wppm sulfur, while simultaneously exhibiting a volumetric energy content of at least about 131,000 BTU/gallon. Additionally or alternatively, the distillate composition may exhibit at least one of the following properties: (i) a cetane number of at least about 50; (ii) a cloud point of less than about −40° C.; (iii) a cold filter plugging point of less than about −20° C.; (iv) a change in viscosity of greater than about 0.40 cSt at about 100° C. to about 200° C.; and (v) a smoke point of at least about 25 mm. Further additionally or alternatively, the distillate composition may exhibit at least two of properties (i)-(v); for example, the distillate composition may exhibit properties: (i) and (ii); (i) and (iii); (i) and (iv); (i) and (v); (ii) and (iii); (ii) and (iv); (ii) and (v); (iii) and (iv); (iii) and (v); or (iv) and (v). Still further additionally or alternatively, the distillate composition may exhibit at least three of properties (i)-(v); for example, the distillate composition may exhibit properties: (i), (ii) and (iii); (i), (ii) and (iv); (i) (ii) and (v); (i), (iii) and (iv); (i), (iii) and (v); (i), (iv) and (v); (iii) and (iv); (ii), (iii) and (v); (ii), (iv) and (v); or (iii), (iv) and (v). Yet further additionally or alternatively, the distillate composition may exhibit at least four of properties (i)-(v); for example, the distillate composition may exhibit properties: (i), (ii), (iii) and (iv); (i), (ii), (iii) and (v); (i), (iii), (iv), and (v); or (ii), (iii), (iv) and (v). Yet still further additionally or alternatively, the distillate composition may exhibit all of properties (i)-(v).

In certain embodiments, the distillate composition may comprise at least about 50 wt % naphthenes and about 10 wt % to about 50 wt % isoparaffins, while simultaneously exhibiting a cloud point of less than about −40° C. and a cold filter plugging point of less than about −22° C. Additionally or alternatively, the distillate composition may exhibit at least one of the following properties: (i) a cetane number of at least about 50; (ii) a smoke point of at least about 25 mm; (iii) a change in viscosity of greater than about 0.40 cSt between about 100° C. and about 200° C.; and (iv) a volumetric energy content of at least about 131,000 BTU/gallon. Further additionally or alternatively, the distillate composition may exhibit at least two of properties (i)-(iv); for example, the distillate composition may exhibit properties: (i) and (ii); (i) and (iii); (i) and (iv); (ii) and (iii); (ii) and (iv); or (iii) and (iv). Still further additionally or alternatively, the distillate composition may exhibit at least three of properties (i)-(iv); for example, the distillate composition may exhibit properties: (i), (ii) and (iii); (i), (ii) and (iv); (i), (iii) and (iv); or (ii), (iii) and (iv). Yet still further additionally or alternatively, the distillate composition may exhibit all of properties (i)-(iv).

III. Distillate Boiling-Range Fuel Blends

In many embodiments, distillate boiling-range fuel blends may comprise a distillate composition as described herein combined with at least a second distillate composition. The second distillate may include, but need not be limited to, off-spec diesel fuel, on-spec diesel fuel (including ultra-low-sulfur diesel fuel), renewable diesel (including FAME and/or pyrolysis oil), light cycle oil, heavy catalytic naphtha, gasoil, straight-run distillate, turbine fuel, kerosene, heating oil, distillate boiling range marine fuel/blendstock, distillate boiling range bunker fuel/blendstock, or the like, or a combination thereof. As used herein, the term "off-spec diesel fuel" refers to a diesel product that does not meet the diesel fuel standard specification according to a standard fuel specification (particularly ASTM D975, but additionally or alternatively including ASTM D390 ASTM D975, ASTM D1655, ASTM D2880, ASTM D6467, EN590, CGSB 3.517, CGSB 3.520, and/or Pipeline Specifications), with the exception of lubricity specifications and conductivity specifications (e.g., which are typically met commercially through the use of additives). In other words, "off-spec diesel fuel" has compositional components and/or properties that fall outside one or more of the non-lubricity and non-conductivity standards provided in a standard fuel specification (particularly ASTM D975, but additionally or alternatively including ASTM D390 ASTM D975, ASTM D1655, ASTM D2880, ASTM D6467, EN590, CGSB 3.517, CGSB 3.520, and/or Pipeline Specifications). As used herein, the term "on-spec diesel fuel" refers to a diesel product having a composition and properties that meet the diesel fuel standard specification according to a standard fuel specification (particularly ASTM D975, but additionally or alternatively including ASTM D390 ASTM D975, ASTM D1655, ASTM D2880, ASTM D6467, EN590, CGSB 3.517, CGSB 3.520, and/or Pipeline Specifications), again with the exception of lubricity specifications and conductivity specifications.

In particular embodiments, the distillate composition may comprise at least about 50 wt % naphthenes and about 10 wt % to about 50 wt % isoparaffins, while simultaneously exhibiting a cloud point of less than about −40° C. and a cold filter plugging point of less than about −22° C. Additionally or alternatively, the distillate composition may further comprise less than about 1.5 wt % aromatics and/or less than about 5 wppm sulfur. Additionally or alternatively, the distillate composition may represent at least about 5.0 vol % of the distillate boiling range fuel blend, e.g., at least about 10 vol %, at least about 15 vol %, at least about 20 vol %, at least about 25 vol %, at least about 30 vol %, at least about 35 vol %, or at least about 40 vol %. Further additionally or alternatively, the distillate composition may represent at most about 40 vol % of the distillate boiling range fuel blend, e.g., at most about 35 vol %, at most about 30 vol %, at most about 25 vol %, at most about 20 vol %, at most about 15 vol %, at most about 10 vol %, or at most about 5.0 vol %. Still further additionally or alternatively, the distillate composition may represent about 5.0 vol % to about 40 vol % of the distillate boiling range fuel blend, e.g., about 5.0 vol % to about 35 vol %, about 5.0 vol % to about 30 vol %, about 5.0 vol % to about 25 vol %, about 5.0 vol % to about 20 vol %, about 5.0 vol % to about 15 vol %, about 5.0 vol % to about 10 vol %, 10 vol % to about 40 vol %, about 10 vol % to about 35 vol %, about 10 vol % to about 30 vol %, about 10 vol % to about 25 vol %, about 10 vol % to about 20 vol %, about 10 vol % to about 15 vol %, 15 vol % to about 40 vol %, about 15 vol % to about 35 vol %, about 15 vol % to about 30 vol %, about 15 vol % to about 25 vol %, about 15 vol % to about 20 vol %, 20 vol % to about 40 vol %, about 20 vol % to about 35 vol %, about 20 vol % to about 30 vol %, about 20 vol % to about 25 vol %, 25 vol % to about 40 vol %, about 25 vol % to about 35 vol %, about 25 vol % to about 30 vol %, 30 vol % to about 40 vol %, about 30 vol % to about 35 vol %, or about 35 vol % to about 40 vol %. In particular, the distillate composition may be present in an amount of about 5.0 vol % to about 40 vol %, e.g., about 5.0 vol % to about 35 vol % or about 10 vol % to about 30 vol %.

Additionally or alternatively, the distillate boiling-range fuel blend may further comprise one or more additives, particularly an additive for improving cold flow properties of the distillate boiling-range fuel blend. As used herein, "cold flow properties" refer to low temperature operability of a fuel (e.g. diesel boiling-range fuel). The term "cold flow properties" encompasses performance properties, such as cloud point, cold filter plugging point, pour point, and/or the like. Examples of suitable additives can include, but are not limited to, antioxidants, metal deactivator (MDA), friction modifiers, middle distillate flow improver (MDFI) additives (e.g., pour point depressants, cloud point modifiers, cold filter plugging point improvers, filterability improvers, and the like, and combinations thereof), cetane improvers, lubricity improvers, corrosion inhibitors, wax anti-settling additives, detergents, static dissipaters, and the like, and combinations thereof.

When present in the distillate boiling-range fuel blend, the additive(s) may comprise at least about 50 vppm of the distillate boiling-range fuel blend, e.g., at least about 100 vppm, at least about 250 vppm, at least about 400 vppm, at least about 550 vppm, at least about 700 vppm, at least about 1000 vppm, at least about 1250 vppm, at least about 1500 vppm, at least about 1750 vppm, or at least about 2000 vppm. Additionally or alternatively, When present in the distillate boiling-range fuel blend, the additive(s) may comprise at most about 2000 vppm of the distillate boiling-range fuel blend, e.g., at most about 1750 vppm, at most about 1500 vppm, at most about 1250 vppm, at most about 1000 vppm, at most about 700 vppm, at most about 550 vppm, at most about 400 vppm, at most about 250 vppm, at most about 100 vppm, or at most about 50 vppm.

Additionally or alternatively, the distillate boiling-range fuel blend may exhibit a cloud point of about 5.0° C. or less, e.g., about 0° C. or less, about −5.0° C. or less, about −6.0° C. or less, about −7.0° C. or less, about −8.0° C. or less, about −9.0° C. or less, about −10° C. or less, about −11° C. or less, about −12° C. or less, about −14° C. or less, or about −16° C. or less. In particular, the diesel boiling-range fuel blend may have a cloud point of about −8.0° C. or less, such as about −9.0° C. or less or about −10° C. or less. Additionally or alternatively, the distillate boiling-range fuel blend may exhibit a cloud point of about 5.0° C. to about −14° C., e.g., about 5.0° C. to about −12° C., about 5.0° C. to about −11° C., about 5.0° C. to about −10° C., about 5.0° C. to about −9.0° C., about 5.0° C. to about −8.0° C., about 5.0° C. to about −5.0° C., about 5.0° C. to about 0° C., about 0° C. to about −14° C., about 0° C. to about −12° C., about 0° C. to about −11° C., about 0° C. to about −10° C., about 0° C. to about −9.0° C., about 0° C. to about −8.0° C., about 0° C. to about −5.0° C., about −5.0° C. to about −14° C., about −5.0° C. to about −12° C., about −5.0° C. to about −11° C., about −5.0° C. to about −10° C., about −5.0° C. to about −9.0° C., about −5.0° C. to about −8.0° C., about −6.0° C. to about −14° C., about −6.0° C. to about −12° C., about −6.0° C. to about −11° C., about −6.0° C. to about −10° C., about −6.0° C. to about −9.0° C., about −6.0° C. to about −8.0° C., about −7.0° C. to about −14° C., about −7.0° C. to about −12° C., about −7.0° C. to about −11° C., about −7.0° C. to about −10° C., about −7.0° C. to about −9.0° C., about −7.0° C. to about −8.0° C., about −8.0° C. to about −14° C., about −8.0° C. to about −12° C., about −8.0° C. to about −11° C., about −8.0° C. to about −10° C., about −8.0° C. to about −9.0° C., about −9.0° C. to about −14° C., about −9.0° C.' to about −12° C., about −9.0° C. to about −11° C., about −9.0° C. to about −10° C., about −10° C. to about −14° C., about −10° C. to about −12° C., or about −10° C. to about −11° C. In particular, the diesel boiling-range fuel blend may have a cloud point of about −5.0° C. to about −14° C., such as about −7.0° C. to about −12° C. or about −8.0° C. to about −11° C.

Additionally or alternatively, the distillate boiling-range fuel blend may exhibit a cold filter plugging point, optionally in combination with the above-described cloud point, of about 5.0° C. or less, e.g., about 0° C. or less, about −5.0° C. or less, about −10° C. or less, about −12° C. or less, about −13° C. or less, about −15° C. or less, about −20° C. or less, about −25° C. or less, about −25° C. or less, about −30° C. or less, about −35° C. or less, or about −40° C. or less. In particular, the diesel boiling-range fuel blend may have a cold filter plugging point, optionally in combination with the above-described cloud point, of about −13° C. or less, such as about −15° C. or less, about −20° C. or less, or about −30° C. or less. Additionally or alternatively, the distillate boiling-range fuel blend may exhibit a cold filter plugging point, optionally in combination with the above-described cloud point, of about 5.0° C. to about −40° C., e.g., about 5.0° C. to about −35° C., about 5.0° C. to about −30° C., about 5.0° C. to about −25° C., about 5.0° C. to about −20° C., about 5.0° C. to about −15° C., about 5.0° C. to about −10° C., about 5.0° C. to about −5.0° C., about 5.0° C. to about 0° C., about 0° C. to about −40° C., about 0° C. to about −35° C., about 0° C. to about −30° C., about 0° C. to about −25° C., about 0° C. to about −20° C., about 0° C. to about −15° C., about 0° C. to about −10° C., about 0° C. to about −5.0° C., about −5.0° C. to about −40° C., about −5.0° C. to about −35° C., about −5.0° C. to about −30° C., about −5.0° C. to about −25° C., about −5.0° C. to about −20° C., about −5.0° C. to about −15° C., about −5.0° C. to about −10° C., about −10° C. to about −40° C., about −10° C. to about −35° C., about −10° C. to about −30° C., about −10° C. to about −25° C., about −10° C. to about −20° C., about −10° C. to about −15° C., about −12° C. to about −40° C., about −12° C. to about −35° C., about −12° C. to about −30° C., about −12° C. to about −25° C., about −12° C. to about −20° C., about −12° C. to about −15° C., about −13° C. to about −40° C., about −13° C. to about −35° C., about −13° C. to about −30° C., about −13° C. to about −25° C., about −13° C. to about −20° C., about −13° C. to about −15° C., about −15° C. to about −40° C., about −15° C. to about −35° C., about −15° C. to about −30° C., about −15° C. to about −25° C., about −15° C. to about −20° C., about −20° C. to about −40° C., about −20° C. to about −35° C., about −20° C. to about −30° C., about −20° C. to about −25° C., about −25° C. to about −40° C., about −25° C. to about −35° C., or about −2.5° C. to about −30° C. In particular, the distillate boiling-range fuel blend may exhibit a cold filter plugging point, optionally in combination with the above-described cloud point, of about −10° C. to about −40° C., such as about −12° C. to about −40° C., about −12° C. to about −35° C., or about −13° C. to about −35° C.

In some embodiments, the distillate boiling-range fuel blend may exhibit a cloud point of less than about −9° C. and a cold filter plugging point of about −13° C. or less. Additionally or alternatively, the distillate boiling-range fuel blend may exhibit a cloud point of about −10° C. or less and a cold filter plugging point of about −15° C. or less. Further additionally or alternatively, the distillate boiling-range fuel blend may exhibit a cloud point of less than or equal to about −10° C. and a cold filter plugging point of less than or equal to about −30° C.

Additionally or alternatively, the distillate boiling-range fuel blend, optionally comprising the additive(s) for improving cold flow properties, may exhibit a difference between cloud point and cold filter plugging point of at least about 2.0° C., e.g., at least about 5.0° C., at least about 7.0° C., at least about 10° C., at least about 15° C., at least about 20° C. or at least about 25° C. Further additionally or alternatively, the distillate boiling-range fuel blend, optionally comprising the additive(s) for improving cold flow properties, may exhibit a difference between cloud point and cold filter plugging point of at most about 25° C., e.g., at most about 20° C., at most about 15° C., at most about 10° C., at most about 7.0° C., at most about 5.0° C., or at most about 2.0° C. Still further additionally or alternatively, the distillate boiling-range fuel blend, optionally comprising the additive(s) for improving cold flow properties, may exhibit a difference between cloud point and cold filter plugging point of about 2.0° C. to about 25° C., e.g., about 5.0° C. to about 25° C., about 7.0° C. to about 25° C., about 10° C. to about 25° C., or about 10° C. to about 20° C.

IV. Method of Increasing Fuel Economy of a Distillate Boiling-Range Fuel/Blend In some embodiments, methods of increasing fuel economy of a distillate (diesel) boiling-range fuel are provided. The method can comprise blending the distillate composition as described herein with at least a second distillate composition (e.g., off-spec diesel fuel; on-spec diesel fuel, including ultra-low-sulfur diesel fuel; renewable diesel, including FAME and/or pyrolysis oil; light cycle oil; heavy catalytic naphtha; gasoil; straight-run distillate; turbine fuel; kerosene; heating oil; distillate boiling range marine fuel/blendstock; distillate boiling range bunker fuel/blendstock; or the like; or a combination thereof).

In particular, the distillate composition may comprise at least about 50 wt % of naphthenes; less than about 1.5 wt % aromatics; and less than about 5 wppm sulfur, and can simultaneously exhibit a volumetric energy content of at least about 125,000 BTU/gallon, e.g., at least about 127,000 BTU/gallon, at least about 131,000 BTU/gallon, at least about 133,000 BTU/gallon, at least about 135,000 BTU/gallon, at least about 137,000 BTU/gallon, or at least about 140,000 BTU/gallon. Additionally or alternatively, the distillate composition may exhibit a volumetric energy content of about 125,000 BTU/gallon to about 140,000 BTU/gallon, e.g., about 125,000 BTU/gallon to about 137,000 BTU/gallon, about 125,000 BTU/gallon to about 135,000 BTU/gallon, about 125,000 BTU/gallon to about 133,000 BTU/gallon, about 125,000 BTU/gallon to about 131,000 BTU/gallon, about 125,000 BTU/gallon to about 127,000 BTU/gallon, about 127,000 BTU/gallon to about 140,000 BTU/gallon, about 127,000 BTU/gallon to about 137,000 BTU/gallon, about 127,000 BTU/gallon to about 135,000 BTU/gallon, about 127,000 BTU/gallon to about 133,000 BTU/gallon, about 127,000 BTU/gallon to about 131,000 BTU/gallon, about 131,000 BTU/gallon to about 131,000 BTU/gallon, about 131,000 BTU/gallon to about 131,000 BTU/gallon, about 131,000 BTU/gallon to about 135,000 BTU/gallon, about 131,000 BTU/gallon to about 133,000 BTU/gallon, about 133,000 BTU/gallon to about 140,000 BTU/gallon, about 133,000 BTU/gallon to about 137,000 BTU/gallon, about 133,000 BTU/gallon to about 135,000 BTU/gallon, about 135,000 BTU/gallon to about 140,000 BTU/gallon, about 135,000 BTU/gallon to about 137,000 BTU/gallon, or about 137,000 BTU/gallon to about 140,000 BTU/gallon. Further additionally or alternatively, the distillate composition may comprise about 10 wt % to about 50 wt % isoparaffins.

Advantageously, a distillate (diesel) boiling-range fuel blend with increased fuel economy may be produced by the methods described herein. After blending of the distillate composition described herein with the second distillate composition as described herein, the distillate boiling-range fuel blend can exhibit a volumetric energy content higher than a volumetric energy content of the second distillate composition. For example, renewable diesel may be blended with the distillate composition described herein to produce a distillate boiling-range fuel with a higher volumetric energy content than the renewable diesel alone, e.g., at least about 1.0% higher, at least about 2.0% higher, at least about 3.0% higher, at least about 4.0% higher, or at least about 5.0% higher.

Additionally or alternatively, the second distillate composition can exhibit a volumetric energy content of at most about 110,000 BTU/gallon, at most about 115,000 BTU/gallon, at most about 117,000 BTU/gallon, at most about 120,000 BTU/gallon, at most about 122,000 BTU/gallon, or at most about 125,000 BTU/gallon. In particular, the second distillate composition can exhibit a volumetric energy content of at most about 122,000 BTU/gallon, at most about 120,000 BTU/gallon, or at most about 117,000 BTU/gallon. Further additionally or alternatively, the second distillate composition can exhibit a volumetric energy content of about 110,000 BTU/gallon to about 125,000 BTU/gallon, e.g., about 110,000 BTU/gallon to about 122,000 BTU/gallon, about 110,000 BTU/gallon to about 120,000 BTU/gallon, about 110,000 BTU/gallon to about 117,000 BTU/gallon, about 110,000 BTU/gallon to about 115,000 BTU/gallon, about 115,000 BTU/gallon to about 125,000 BTU/ gallon, about 115,000 BTU/gallon to about 122,000 BTU/gallon, about 115,000 BTU/gallon to about 120,000 BTU/gallon, about 115,000 BTU/gallon to about 117,000 BTU/gallon, about 117,000 BTU/gallon to about 125,000 BTU/gallon, about 117,000 BTU/gallon to about 122,000 BTU/gallon, about 117,000 BTU/gallon to about 120,000 BTU/gallon, about 120,000 BTU/gallon to about 125,000 BTU/gallon, about 120,000 BTU/gallon to about 122,000 BTU/gallon, or about 122,000 BTU/gallon to about 125,000 BTU/gallon. In particular, the second distillate composition can exhibit a volumetric energy content of about 110,000 BTU/gallon to about 125,000 BTU/gallon, such as about 115,000 BTU/gallon to about 125,000 BTU/gallon or about 115,000 BTU/gallon to about 120,000 BTU/gallon.

Still further additionally or alternatively, the distillate (diesel) boiling-range fuel may exhibit a volumetric energy content of at least about 122,000 BTU/gallon, e.g., at least about 125,000 BTU/gallon, at least about 127,000 BTU/gallon, at least about 130,000 BTU/gallon, at least about 132,000 BTU/gallon, or at least about 135,000 BTU/gallon. Yet further additionally or alternatively, the distillate (diesel) boiling-range fuel may exhibit a volumetric energy content of about 122,000 BTU/gallon to about 135,000 BTU/gallon, e.g., about 122,000 BTU/gallon to about 132,000 BTU/gallon, about 122,000 BTU/gallon to about 130,000 BTU/gallon, about 122,000 BTU/gallon to about 127,000 BTU/gallon, about 122,000 BTU/gallon to about 125,000 BTU/gallon, about 125,000 BTU/gallon to about 135,000 BTU/gallon, about 125,000 BTU/gallon to about 132,000 BTU/gallon, about 125,000 BTU/gallon to about 130,000 BTU/gallon, about 125,000 BTU/gallon to about 127,000 BTU/gallon, about 127,000 BTU/gallon to about 135,000 BTU/gallon, about 127,000 BTU/gallon to about 132,000 BTU/gallon, about 127,000 BTU/gallon to about 130,000 BTU/gallon, about 130,000 BTU/gallon to about 135,000 BTU/gallon, about 130,000 BTU/gallon to about 132,000 BTU/gallon or about 132,000 BTU/gallon to about 135,000 BTU/gallon.

In certain embodiments, the second distillate composition may exhibit a volumetric energy content of at most about 120,000 BTU/gallon before blending with the distillate composition as described herein, and the resultant distillate (diesel) boiling-range fuel blend may exhibit a volumetric energy content of at least about 125,000 BTU/gallon. In certain embodiments, the second distillate composition may exhibit a volumetric energy content of at most about 120,000 BTU/gallon before blending with the distillate composition as described herein, and the resultant distillate (diesel) boiling-range fuel may exhibit a volumetric energy content of at least about 130,000 BTU/gallon.

V. Other Methods

Other methods of improving emissions, producing improved distillate (diesel) boiling-range fuel/blends, and/or upgrading lower quality blendstocks are contemplated herein.

In various aspects, methods of improving emissions from a combustion engine, such as a diesel engine, are provided herein. The methods may comprise providing the distillate composition described herein (e.g. in neat form or blended, such as with a second distillate composition described herein) to a combustion engine (e.g., a diesel engine). In combustion engines using common rail fuel injection systems, the distillate composition can be injected at a temperature between about 100° C. and about 200° C. In particular, the distillate composition may exhibit a viscosity of about 0.50 cSt to about 0.008 cSt at about 100° C. to about 200° C. and/or a change in viscosity of greater than about 0.40 cSt between about 100° C. and about 200° C.

In various aspects, methods of improving cetane number of a distillate composition having a low cetane number are provided herein. The methods may comprise blending the distillate composition having a low cetane number with a distillate composition as described herein in a sufficient amount to produce a blend product having a cetane number at least 5 higher than the low cetane number (e.g., at least 7 higher, at least 10 higher, at least 13 higher, at least 15 higher, at least 18 higher, at least 20 higher, at least 23 higher, at least 25 higher, at least 30 higher, or at least 35 higher). As used herein, the term "low cetane number" should be understood in relation to worldwide specifications for diesel fuels (the current specification for diesel fuels in the U.S. and Canada includes a minimum cetane number of 40, and the current specification for European diesel fuels includes a minimum cetane number of 51); thus, as used herein, "low cetane number" should be understood to refer to a cetane number of about 28 or less, e.g., about 25 or less, about 22 or less, about 20 or less, about 17 or less, or about 15 or less. Although, advantageously, the methods of improving cetane number can result in a distillate blend product having a cetane number achieving at least one of the worldwide specifications for diesel fuel, it is contemplated that the methods of improving cetane number can alternatively result in a distillate blend product having a cetane number of at least about 6 below a desired diesel fuel cetane number specification (e.g., at least about 5 below, at least about 4 below, at least about 3 below, at least about 2 below, or at least about 1 below), such that the distillate blend product can have its cetane number further increased to at least the desired diesel fuel cetane number specification through use of a sufficient amount of a cetane improver additive (which amount can depend greatly on how far below the desired diesel fuel cetane number specification is before additizing). Examples of distillate compositions having low cetane numbers can include, but are not limited to, light cycle oils, heavy catalytic naphthas, and other refinery streams that have been subject to cracking (hydrocracking and/or thermal cracking).

In various aspects, methods of reducing aromatics content of a distillate composition having high aromatics content are provided herein. The methods may comprise blending the distillate composition having a high aromatics content with a distillate composition as described herein in a sufficient amount to produce a blend having an aromatics content at least about 10 wt % lower than the high aromatics content (e.g., at least about 15 wt % lower, at least about 20 wt % lower, at least about 25 wt % lower, at least about 30 wt % lower, at least about 35 wt % lower, at least about 40 wt % lower, at least about 45 wt % lower, at least about 50 wt % lower, at least about 55 wt % lower, or at least 65 wt % lower). As used herein, the term "high aromatics content" should be understood in relation to the typical range of aromatics content in diesel fuels; thus, as used herein, "high aromatics content" should be understood to refer to an aromatics content of about 45 wt % or more, e.g., about 50 wt % or more, about 55 wt % or more, about 60 wt % or more, about 65 wt % or more, about 70 wt % or more, or about 75 wt % or more. Examples of distillate compositions having high aromatics contents can include, but are not limited to, light cycle oils, heavy catalytic naphthas, and other refinery streams that have been subject to cracking (hydrocracking and/or thermal cracking).

In various aspects, methods of reducing sulfur content of a distillate composition having high sulfur content are provided herein. The methods may comprise blending the distillate composition having a high sulfur content with a distillate composition as described herein in a sufficient amount to produce a mixture having a lower sulfur content number than the distillate composition having high sulfur content.

In various aspects, methods of improving cloud point of a distillate composition with a high cloud point are provided herein. The methods may comprise blending the distillate composition having a high cloud point with a distillate composition as described herein in a sufficient amount to produce a mixture having a lower cloud point than the distillate composition having a high cloud point.

VII. Further Embodiments

The invention can additionally or alternately include one or more of the following embodiments.

Embodiment 1

A distillate composition comprising: at least about 50 wt % (e.g., at least about 60 wt %) naphthenes (e.g., single ring naphthenes and/or multi-ring naphthenes); less than about 1.5 wt % (e.g., less than about 1.0 wt % or less than about 0.5 wt %) aromatics; about 10 wt % to about 50 wt % (e.g., about 20 wt % to about 50 wt %) isoparaffins; and optionally less than about 5 wppm sulfur.

Embodiment 2

A distillate composition comprising: at least about 50 wt % (e.g., at least about 60 wt %) naphthenes (e.g., single ring naphthenes and/or multi-ring naphthenes); less than about 1.5 wt % (e.g., less than about 1.0 wt % or less than about 0.5 wt %) aromatics; less than about 5 wppm sulfur; and optionally about 10 wt % to about 50 wt % (e.g., about 20 wt % to about 50 wt %) isoparaffins, wherein the distillate composition simultaneously exhibits a volumetric energy content of at least about 131,000 BTU/gallon (e.g., at least about 135,000 BTU/gallon).

Embodiment 3

A distillate composition comprising: at least about 50 wt % (e.g., at least about 60 wt %) naphthenes single ring naphthenes and/or multi-ring naphthenes); about 10 wt % to about 50 wt % (e.g., about 20 wt % to about 50 wt %) isoparaffins; optionally, less than about 1.5 wt % (e.g., less than about 1.0 wt % or less than about 0.5 wt %) aromatics; and optionally, less than about 5 wppm sulfur, wherein the distillate composition simultaneously exhibits a cloud point of less than about −40° C. and a cold filter plugging point less than about −22° C.

Embodiment 4

The distillate composition of any one of the previous embodiments, wherein the distillate composition has at least one (e.g., one, two, three, four, five, or six) of the following properties: (i) a cetane number of at least about 50; (ii) cloud point of less than about −40° C.; (iii) a cold filter plugging point of less than about −20° C.; (iv) a smoke point of at least about 25 mm; (v) a change in viscosity of greater than about 0.40 cSt between about 100° C. and about 200° C.; and (vi) a volumetric energy content of at east about 131,000 BTL/gallon (e.g., at least about 135,000 BTU/gallon).

Embodiment 5

The distillate composition of any one of the previous embodiments wherein single ring naphthenes are present in an amount of at least about 50% w/w relative to a total amount of naphthenes, or wherein multi-ring naphthenes are present in an amount of at least about 50% w/w relative to a total amount of naphthenes.

Embodiment 6

The distillate composition of any one of the previous embodiments, wherein a w/w ratio of single ring naphthenes to total naphthenes is about 2:5 to about 5:8, or wherein a w/w ratio of multi-ring naphthenes to total naphthenes is about 2:5 to about 5:8.

Embodiment 7

The distillate composition of any one of the previous embodiments, wherein single ring naphthenes and multi-ring naphthenes are present in a w/w ratio of about 2:3 to about 3:2.

Embodiment 8

The distillate composition of any one of the previous embodiments, wherein the multi-ring naphthenes are selected from the group consisting of two-ring naphthenes, three-ring naphthenes, four-ring naphthenes, five-ring naphthenes, six-ring naphthenes, and a combination thereof.

Embodiment 9

The distillate composition of any one of the previous embodiments, wherein single ring naphthenes and two-ring naphthenes are present in a collective amount of at least about 60% w/w relative to the total amount of naphthenes and/or wherein four-ring naphthenes, five-ring naphthenes, and six-ring naphthenes are present in a collective amount of about 5.0% w/w to about 12% w/w relative to the total amount of naphthenes.

Embodiment 10

The distillate composition of any one of the previous embodiments, which satisfies one or more (e.g., one, two, or three) of the following: (i) four-ring naphthenes are present in an amount of about 2.0% w/w to about 10% w/w of the total amount of naphthenes; (ii) five-ring naphthenes are present in an amount of about 1.0% w/w to about 2.6% w/w of the total amount of naphthenes; and (iii) six-ring naphthenes are present in an amount of about 0.20% w/w to about 1.0% w/w of the total amount of naphthenes.

Embodiment 11

The distillate composition of any one of the previous embodiments, further comprising less than about 10 wt % of n-paraffins and/or wherein n-paraffins are present in an amount of less than about 20% w/w relative to a total amount of non-cyclic paraffins in the distillate composition.

Embodiment 12

A diesel boiling-range fuel blend comprising the distillate composition of any one of the previous embodiments (e.g., present in an amount of at least about 10 vol %, at least about 25 vol %, at least about 50 vol %, or at least about 75 vol %), a second distillate composition (e.g., present in an amount of at most about 90 vol %, at most about 75 vol %, at most about 50 vol %, or at most about 25 vol %), and, optionally, an additive for improving cold flow properties (e.g., present in an amount of at least about 100 vppm, at least about 400 vppm, at least about 700 vppm and/or in an amount of at most about 2000 vppm).

Embodiment 13

A method of producing diesel boiling-range fuel with improved cold flow properties, the method comprising blending the distillate composition of any one of embodiments 1-11 (e.g., present in an amount of at least about 10 vol %, at least about 25 vol %, at least about 50 vol %, or at least about 75 vol %) with a second distillate composition (e.g., present in an amount of at most about 90 vol %, at most about 75 vol %, at most about 50 vol %, or at most about 25 vol %), and optionally with an additive for improving cold flow properties (e.g., present in an amount of at least about 100 vppm, at least about 400 vppm, at least about 700 vppm and/or in an amount of at most about 2000 vppm) to form the diesel boiling-range fuel.

Embodiment 14

A method of increasing fuel economy of a diesel boiling-range fuel, the method comprising blending the distillate composition of any one of embodiments 1-11 (e.g., present in an amount of at least about 10 vol %, at least about 25 vol %, at least about 50 vol %, or at least about 75 vol %) with a second distillate composition (e.g., present in an amount of at most about 90 vol %, at most about 75 vol %, at most about 50 vol %, or at most about 25 vol %) to form the diesel boiling-range fuel.

Embodiment 15

The diesel boiling-range fuel blend of embodiment 12 or the method of embodiment 13 or embodiment 14, wherein the diesel boiling-range fuel exhibits a cloud point and a cold filter plugging point, both of which are less than a corresponding cloud point and a corresponding cold filter plugging point of the second distillate composition before blending with the distillate composition.

Embodiment 16

The diesel boiling-range fuel blend of embodiment 12 or embodiment 15 or the method of any one of embodiments 13-15, wherein the diesel boiling-range fuel exhibits a cloud point of less than about −9° C. (e.g., about −10° C. or less), a cold filter plugging point of about −13° C. or less (e.g., about −15° C. or less or about −30° C. or less), and/or at least about 10° C. difference between cloud point and cold filter plugging point.

Embodiment 17

The diesel boiling-range fuel blend of any one of embodiments 12 and 15-16 or the method of any one of embodiments 13-16, wherein the second distillate composition is selected from the group consisting of off-spec diesel fuel, on-spec diesel fuel, renewable diesel, light cycle oil, heavy catalytic naphtha, gasoil, straight-run distillate, turbine fuel, kerosene, heating oil, distillate boiling range marine fuel/blendstock, distillate boiling range bunker fuel/blendstock, and a combination thereof.

Embodiment 18

The diesel boiling-range fuel blend of any one of embodiments 12 and 15-17 or the method of any one of embodiments 13-17, wherein, after blending the second distillate composition and the distillate composition, the diesel boiling-range fuel exhibits a volumetric energy content higher than a corresponding volumetric energy content of the second distillate composition before blending with the distillate composition.

Embodiment 19

The diesel boiling-range fuel blend of any one of embodiments 12 and 15-18 or the method of any one of embodiments 13-18, wherein the second distillate composition exhibits a volumetric energy content of at most about 120,000 BTU/gallon before blending with the distillate composition, and wherein the diesel boiling-range fuel exhibits a volumetric energy content of at least about 125,000 BTU/gallon (e.g., at least about 130,000 BTU/gallon).

Embodiment 20

The diesel boiling-range fuel blend of any one of embodiments 12 and 15-19 or the method of any one of embodiments 13-19, wherein the second distillate composition comprises or is renewable diesel, and wherein the diesel boiling-range fuel exhibits a volumetric energy content at least 3% higher than a corresponding volumetric energy content of the renewable diesel before blending with the distillate composition.

EXAMPLES

Example 1—Distillate Stream Property Study

Distillate streams 1 and 2, having the compositions provided in Table 1, were tested to determine the following properties: Cetane index (tested according to ASTM D4737); Cetane number (tested according to ASTM D7668); Cloud point (tested according to ASTM D5771); Density at 15° C. (tested according to ASTM D4052); Pour point (tested according to ASTM D5950); Sulfur content (tested according to ASTM D2622); Viscosity at 40° C. (tested according to ASTM D445); and Smoke point (tested according to ASTM D1322). The results of the testing are shown in Table 2.

TABLE 1

| Distillate Stream Compositions | | |
|---|---|---|
| | Distillate Stream 1 | Distillate Stream 2 |
| GC-FIMS | | |
| paraffins (wt %) | ~8.4 | ~9.2 |
| 1-ring naphthenes (wt %) | ~39.0 | ~37.8 |
| 2-ring naphthenes (wt %) | ~32.6 | ~32.9 |
| 3-ring naphthenes (wt %) | ~11.6 | ~12.4 |
| 4-ring naphthenes (wt %) | ~5.9 | ~5.5 |

TABLE 1-continued

| Distillate Stream Compositions | | |
|---|---|---|
| | Distillate Stream 1 | Distillate Stream 2 |
| 5-ring naphthenes (wt %) | ~1.8 | ~1.7 |
| 6-ring naphthenes (wt %) | ~0.6 | ~0.4 |
| Total (wt %) | ~99.8 | ~99.9 |
| 2D GC (UOP 990) | | |
| n-paraffins (wt %) | ~5.0 | ~5.2 |
| i-paraffins (wt %) | ~28.4 | ~25.9 |
| cycloparaffins (wt %) | ~61.9 | ~60.6 |
| aromatics (wt %) | ~4.7 | ~8.2 |
| Total (wt %) | ~100 | ~99.9 |
| SFC Aromatics (D5186) | | |
| paraffins (wt %) | ~20.7 | ~21.0 |
| 1-ring naphthenes (wt %) | ~41.9 | ~37.7 |
| 2+ ring naphthenes (wt %) | ~37.4 | ~41.3 |
| 1-ring aromatics (wt %) | ~0 | ~0 |
| 2-ring aromatics (wt %) | ~0 | ~0 |
| 3+ ring aromatics (wt %) | ~0 | ~0 |
| total naphthenes (wt %) | ~79.3 | ~79.0 |
| total aromatics (wt %) | ~0 | ~0 |
| Total (wt %) | ~100 | ~100 |

TABLE 2

| Distillate Stream Properties | | |
|---|---|---|
| Property | Distillate Stream 1 | Distillate Stream 2 |
| Cetane Index | ~57 | ~59 |
| Cetane Number | ~57 | ~58 |
| Cloud Point (° C.) | ~−54 | ~−47 |
| Density @ ~15° C. (kg/m$^3$) | ~830 | ~832 |
| Pour Point (° C.) | ~−54 | ~−48 |
| Sulfur content (mg/kg) | ≤3 | ≤3 |
| Viscosity @ ~40° C. (mm$^2$/s) | ~3.2 | ~3.8 |
| Smoke point (mm) | ~30 | ~30 |

GC-FIMS, 2D GC, and SFC Aromatics were the chosen analysis methods. Although the 2D GC method appeared to show aromatic content in both of Distillate Streams 1 and 2, it is believed that more accurate measures of the actual aromatics content can be gleaned from the GC-FIMS and SFC Aromatics tests, which are more quantitative for aromatics content—both those tests showed less than 1 wt % aromatics content, which was confirmed to be less than 100 wppm (e.g., less than 50 wppm or less than 20 wppm), based on further analysis using EN12916 test/calibration procedures. It is believed that the reason for this different result in 2D GC may be because 2D GC analysis uses grouping or binning to assign peaks to a compound class. Gas chromatography methods operate on specific elution time of compounds. Without being bound by theory, it is believed that the elution time for some of the more complex, multi-ring naphthene components may be similar to elution times previously thought to be indicative only of certain (single-ring) aromatics components.

In GC-FIMS, each sample is typically separated into saturate and aromatic fractions according to method IP368. However, since no aromatic fraction was detected, the saturate fraction was introduced into the instrument using a heated direct insertion probe and analysed using a Micromass ZabSpec™ magnetic sector mass spectrometer operating in the FI mode over a mass range of 100-1000 Daltons. Samples were subject to an intense electric field (~11 kV) in the FIMS source, and ions created by removal of an electron by quantum electron tunnelling. The paraffin content was determined on the saturate fraction by GC-FID on a 5 m ZB-1XT column according to method IP480 (EN 15199-1). Each sample was diluted in carbon disulfide prior to analysis, and the paraffin content calculated by integrating the paraffin peak areas valley to valley. Identification of paraffins was by retention time comparison with a reference standard of Polywax™ 1000, and quantification was by normalized area percent.

Example 2—FAME Blending

Regulations can obligate refiners to blend fatty acid methyl ester (FAME) into diesel fuel. While FAME can typically exhibit relatively high cetane, its relatively high density (e.g., 880 kg/m$^3$ by EN ISO 3675, at ~15° C.) compared to the EN 590 specification of 845 kg/m$^3$ (by the same method) maximum and its high cloud point (e.g., about −3° C.' to about 16° C. by EN 23015) compared to the EN 590 specification range of −34° C. to −10° C. can be problematic. To compensate for these deficiencies in a diesel fuel blend, typically a kerosene boiling-range material (e.g., density~800 kg/m$^3$, cloud point≤−40° C.) would be used, but it can sometimes undesirably lower cetane number and volumetric energy density. Typical kerosene cetane number can be ~35-45 compared to the EN 590 specification of 51 minimum. A naphthene-containing distillate composition, as described herein, is blended instead of kerosene, resulting in improved cloud point and density, while maintaining or improving cetane number and volumetric energy density of the blend.

Example 3—LCO Upgrading

Light cycle oil (LCO) produced from fluid catalytic cracking processes is a relatively low value diesel blendstock with a relatively high density (>1 g/m$^3$ at ~15° C.), relatively low cetane number (e.g., ~15-25), and relatively high sulfur content (e.g., ≥1000 wppm). LCO may be hydrotreated to lower sulfur content. Upgrading more LCO or hydrofined LCO into the diesel pool can offer a margin improvement to refiners. LCO is typically blended into a pool of conventional distillate (diesel fuel) blendstock, up to a critical limit, e.g., maximum density, maximum sulfur, and/or minimum cetane. A naphthene-containing distillate composition, as described herein (density~800 kg/m$^3$, cloud point~−31° C., and cetane number~75) is blended in place of some or all of the conventional distillate blendstock, resulting in simultaneous improvement in cetane number, sulfur content, and density, while maintaining or improving cloud point. A combination of conventional distillate blendstock and lubricant hydrocracker distillate allows more LCO to be blended into the diesel pool.

Example 4—Enemy Content Study

Distillate Stream 1 and Distillate Stream 2 were analyzed for volumetric energy content according to ASTM D4809, as were samples of renewable diesel, FAME, and standard #2 diesel, for comparison. Density was also measured. The results are shown in Table 3.

TABLE 3

| Energy Content Comparison | | | | | |
|---|---|---|---|---|---|
| Sample | Typical Energy Content (BTU/lb) | Energy Content (BTU/gallon) | Percent Change (BTU/gallon) relative to Distillate Stream 1 | Percent Change (BTU/gallon) relative to Distillate Stream 2 | Density (lb/gallon) |
| Distillate Stream 1 | ~19700 | ~137000 | — | ~−0.2% | ~6.93 |
| Distillate Stream 1 | ~19700 | ~137000 | ~0.2% | — | ~6.95 |
| #2 Diesel | ~20000 | ~139000 | ~1.3% | ~1.1% | ~6.94 |
| Renewable Diesel | ~20100 | ~131000 | ~−4.4% | ~−4.6% | ~6.51 |
| FAME | ~17500 | ~128000 | ~−6.4% | ~−6.6% | ~7.33 |

Example 5—Cold Flow Property Study

Cloud point analyses were accomplished according to ASTM D6371, and cold filter point plugging (CFPP) analyses were accomplished according to ASTM D5771 for the compositions in Table 4, in order to examine improvements in cold flow properties of Base Diesel (which represents an approximation of commercial diesel) with the addition of Distillate Stream 2 and/or an MDFI additive. The results are shown in FIG. 1.

TABLE 4

| Cold Flow Property Study Compositions | |
|---|---|
| A | Base Diesel |
| B | Distillate Stream 2 |
| C | Base Diesel + 10% v Distillate Stream 2 |
| D | Base Diesel + 30% v Distillate Stream 2 |
| E | Base Diesel + 100 ppm MDFI |
| F | Base Diesel + 10% v Distillate Stream 2 + 100 ppm MDFI |
| G | Base Diesel + 30% v Distillate Stream 2 + 100 ppm MDFI |
| H | Base Diesel + 450 ppm MDFI |
| I | Base Diesel + 10% v Distillate Stream 2 + 450 ppm MDFI |
| J | Base Diesel + 30% v Distillate Stream 2 + 450 ppm MDFI |
| K | Base Diesel + 800 ppm MDFI |
| L | Base Diesel + 10% v Distillate Stream 2 + 800 ppm MDFI |
| M | Base Diesel + 30% v Distillate Stream 2 + 800 ppm MDFI |

Example 6—Viscosity Comparison Study

Figure 2:
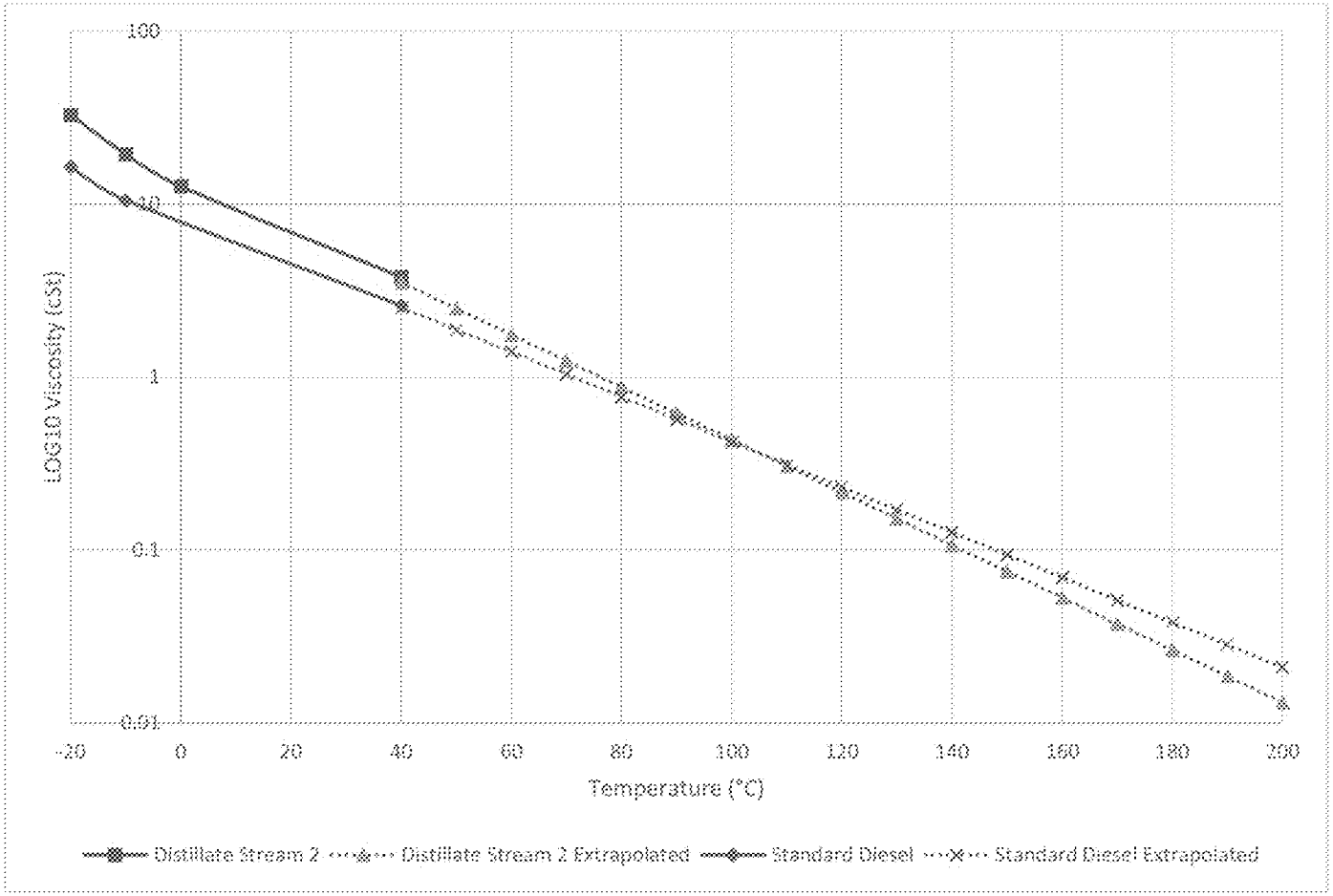
FIG. 2 illustrates viscosity comparison between distillate stream 2 and a standard diesel fuel.

Viscosity was measured according to ASTM D445 for Distillate Stream 2 and standard U.S. diesel fuel (certified in 2007 for emissions testing; purchased from Chevron) at various temperatures as shown in Table 5. The comparison between Distillate Stream 2 and standard diesel fuel viscosity (measured and extrapolated values) is shown in FIG. 2.

TABLE 5

| Viscosity Comparison of Distillate Stream 2 and Standard Diesel Fuel | | |
|---|---|---|
| Temperature (° C.) | Distillate Stream 2 Viscosity (cSt) | Standard Diesel Fuel Viscosity (cSt) |
| −20(m) | 32.56 | 16.37 |
| −10(m) | 19.32 | 10.53 |
| 0(m) | 12.63 | — |
| 40(m) | 3.542 | 2.544 |
| 50(e) | 2.496 | 1.885 |
| 60(e) | 1.759 | 1.396 |
| 70(e) | 1.239 | 1.034 |
| 80(e) | 0.873 | 0.766 |

TABLE 5-continued

| Viscosity Comparison of Distillate Stream 2 and Standard Diesel Fuel | | |
|---|---|---|
| Temperature (° C.) | Distillate Stream 2 Viscosity (cSt) | Standard Diesel Fuel Viscosity (cSt) |
| 90(e) | 0.615 | 0.568 |
| 100(e) | 0.434 | 0.421 |
| 110(e) | 0.306 | 0.312 |
| 120(e) | 0.215 | 0.731 |
| 130(e) | 0.152 | 0.171 |
| 140(e) | 0.107 | 0.127 |
| 150(e) | 0.075 | 0.094 |
| 160(e) | 0.053 | 0.070 |
| 170(e) | 0.037 | 0.052 |
| 180(e) | 0.026 | 0.038 |
| 190(e) | 0.019 | 0.028 |
| 200(e) | 0.013 | 0.021 |

(m)= measured;
(e)= linearly extrapolated from temp vs. log(viscosity) plot

Although the present invention has been described in terms of specific embodiments, it is not so limited. Suitable alterations/modifications for operation under specific conditions should be apparent to those skilled in the art. It is therefore intended that the following claims be interpreted as covering all such alterations/modifications as fall within the true spirit/scope of the invention.

The invention claimed is:

1. A diesel boiling-range fuel composition comprising:
at least about 50 wt % naphthenes;
less than about 1.5 wt % aromatics; and
about 10 wt % to about 50 wt % non-cyclic paraffins;
wherein the composition has a cetane number of at least about 50, measured according to ASTM D7668; and
wherein the composition satisfies one or more of the following:
(i) four-ring naphthenes are present in an amount of about 2.0% w/w to about 10% w/w relative to the total amount of naphthenes;
(ii) five-ring naphthenes are present in an amount of about 1.0% w/w to about 2.6% w/w relative to the total amount of naphthenes; and
(iii) six-ring naphthenes are present in an amount of about 0.20% w/w to about 1.0% w/w relative to the total amount of naphthenes.

2. The composition of claim 1, wherein the naphthenes are present in an amount of at least about 60 wt %.

3. The composition of claim 1, comprising about 10 wt % to about 50 wt % isoparaffins.

4. The composition of claim 1, wherein single ring naphthenes are present in an amount of at least about 50% w/w relative to a total amount of naphthenes.

5. The composition of claim 4, wherein a w/w ratio of the single ring naphthenes to the total naphthenes is about 2:5 to about 5:8.

6. The composition of claim 1, wherein multi-ring naphthenes are present in an amount of at least about 50% w/w relative to a total amount of naphthenes.

7. The composition of claim 6, wherein a w/w ratio of the multi-ring naphthenes to the total naphthenes is about 2:5 to about 5:8.

8. The composition of claim 1, wherein single ring naphthenes and multi-ring naphthenes are present in a w/w ratio of about 2:3 to about 3:2.

9. The composition of claim 6, wherein the multi-ring naphthenes are selected from the group consisting of two-ring naphthenes, three-ring naphthenes, four-ring naphthenes, five-ring naphthenes, six-ring naphthenes, and a combination thereof.

10. The composition of claim 9, wherein single ring naphthenes and two-ring naphthenes are present in a collective amount of at least about 60% w/w relative to the total amount of naphthenes.

11. The composition of claim 9, wherein four-ring naphthenes, five-ring naphthenes, and six-ring naphthenes are present in a collective amount of about 5.0% w/w to about 12% w/w relative to the total amount of naphthenes.

12. The composition of claim 1, wherein the composition satisfies at least two of (i)-(iii).

13. The composition of claim 1, wherein the composition satisfies (i)-(iii).

14. The composition of claim 1, wherein the composition comprises less than about 10 wt % of n-paraffins.

15. The composition of claim 1, wherein n-paraffins are present in an amount of less than about 20% w/w relative to a total amount of non-cyclic paraffins in the distillate composition.

16. The composition of claim 1, further comprising less than about 5 wppm sulfur.

17. The composition of claim 1, which exhibits at least one of the following properties:

(i) cloud point of less than about −40° C.;

(ii) a cold filter plugging point of less than about −20° C.;

(iii) a smoke point of at least about 25 mm;

(iv) a change in viscosity of greater than about 0.400 cSt between about 100° C. and about 200° C.; and (v) a volumetric energy content of at least about 131,000 BTU/gallon.

18. The composition of claim 17, which exhibits at least two of properties ((i)-(v).

19. The composition of claim 17, which exhibits at least three of properties ((i)-(v).

20. The composition of claim 17, which exhibits at least four of properties (i)-(v).

21. The composition of claim 17, which exhibits properties (i)-(v).

* * * * *